US008302875B2

(12) United States Patent
Higuma et al.

(10) Patent No.: US 8,302,875 B2
(45) Date of Patent: Nov. 6, 2012

(54) AIRCONDITIONING EQUIPMENT, SIGNAL TRANSMISSION METHOD, AND SIGNAL TRANSMISSION METHOD FOR AIR CONDITIONING EQUIPMENT

(75) Inventors: Toshiyasu Higuma, Chiyoda-ku (JP); Noriyuki Kushiro, Chiyoda-ku (JP); Yoshiaki Koizumi, Chiyoda-ku (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 167 days.

(21) Appl. No.: 12/849,283

(22) Filed: Aug. 3, 2010

(65) Prior Publication Data

US 2010/0317287 A1 Dec. 16, 2010

Related U.S. Application Data

(62) Division of application No. 10/592,137, filed as application No. PCT/JP2005/002878 on Feb. 23, 2005, now Pat. No. 7,921,665.

(30) Foreign Application Priority Data

Mar. 9, 2004 (JP) ..... 2004-065705
Jul. 29, 2004 (JP) ..... 2004-221923

(51) Int. Cl.
*G05D 23/00* (2006.01)

(52) U.S. Cl. ..... 236/51; 62/298; 174/15.1; 342/22
(58) Field of Classification Search ..... 236/51; 62/298; 174/15.1, 15.2; 342/22
See application file for complete search history.

(56) References Cited

U.S. PATENT DOCUMENTS

| | | | | |
|---|---|---|---|---|
| 4,845,308 | A | 7/1989 | Womack | |
| 6,865,898 | B2 * | 3/2005 | Yamanashi et al. | 62/132 |
| 6,978,627 | B2 * | 12/2005 | Masui et al. | 62/127 |
| 2008/0032621 | A1 | 2/2008 | Higuma et al. | |
| 2010/0063772 | A1 * | 3/2010 | Kim et al. | 702/159 |
| 2011/0219795 | A1 * | 9/2011 | Ahn et al. | 62/125 |
| 2011/0219798 | A1 * | 9/2011 | Kim et al. | 62/129 |
| 2011/0224833 | A1 * | 9/2011 | Kim et al. | 700/276 |

FOREIGN PATENT DOCUMENTS

EP 1 251 582 10/2002

(Continued)

OTHER PUBLICATIONS

Extended Search Report from European Patent Office issued in Applicant's related European Patent Application No. 10006827.9 dated Sep. 10, 2010.
Extended Search Report from European Patent Office issued in Applicant's related European Patent Application No. 10006828.7 dated Sep. 13, 2010.

(Continued)

*Primary Examiner* — Marc Norman
(74) *Attorney, Agent, or Firm* — Buchanan Ingersoll & Rooney PC

(57) ABSTRACT

An air conditioning equipment having an in-room unit connected to one end of the refrigerant pipes and an out-room unit connected to the other end of the refrigerant pipes. The air conditioning equipment includes signal coupling portions which are respectively disposed at both end parts of the refrigerant pipes. Each of the signal coupling portions couples an alternating current (AC) control signal to the refrigerant pipes and exhibits a predetermined impedance with respect to an AC electric signal. The configuration of the air conditioning equipment brings forth the advantages that the electrical insulation devices used in the prior art are dispensed with, and the signal transmissions between the in-room unit and the out-room unit can be performed by a simple apparatus configuration.

10 Claims, 18 Drawing Sheets

FOREIGN PATENT DOCUMENTS

| | | | | |
|---|---|---|---|---|
| JP | 57-012240 | | | 1/1982 |
| JP | 62-210342 | | | 9/1987 |
| JP | 62210342 | A | * | 9/1987 |
| JP | 06-002880 | A | | 1/1994 |
| JP | 06-050592 | | | 2/1994 |
| JP | 07-243691 | | | 9/1995 |
| JP | 09-224235 | | | 8/1997 |
| JP | 2000-286758 | | | 8/2000 |
| JP | 2001-099475 | | | 4/2001 |
| JP | 2001-132959 | | | 5/2001 |
| JP | 2003-090586 | | | 3/2003 |
| JP | 2003-106622 | A | | 4/2003 |
| JP | 2003269749 | A | * | 9/2003 |
| JP | 2006-210231 | A | | 8/2006 |
| JP | 2008-101911 | A | | 5/2008 |

OTHER PUBLICATIONS

Chinese Office Action dated Dec. 28, 2007 (with English Translation).

Notification of Reason for Refusal in JP 2004-221923 dated Sep. 9, 2008, and English translation thereof.

Supplementary European Search Report in Application No. 05710571.0-2301 dated Nov. 5, 2008.

Korean Office Action dated Apr. 21, 2010 in corresponding Korean Application No. 10-2010-7000676, and English language translation, 16 pages.

Notification of Reasons for Refusal issued Mar. 30, 2012 by the Japanese Patent Office in corresponding Japanese Application No. 2010-256855, and an English translation thereof.

* cited by examiner

AIRCONDITIONING EQUIPMENT, SIGNAL TRANSMISSION METHOD, AND SIGNAL TRANSMISSION METHOD FOR AIR CONDITIONING EQUIPMENT

TECHNICAL FIELD

The present invention relates to an airconditioning equipment wherein devices are separately arranged inside and outside a room, and they fulfill functions while exchanging control signals each other, a signal transmission method, and a signal transmission method for an airconditioning equipment.

BACKGROUND ART

A prior-art airconditioning equipment has been so configured that electrical insulation devices are disposed on the in-room unit side and out-room unit side of each of the gas-side refrigerant pipe and liquid-side refrigerant pipe of an airconditioning equipment which is divided into an in-room unit and an out-room unit, and that the control circuit board of the in-room unit is connected with the gas-side refrigerant pipe and the liquid-side refrigerant pipe, while the control circuit board of the out-room unit is connected with the gas-side refrigerant pipe and the liquid-side refrigerant pipe, whereby the gas-side and liquid-side refrigerant pipes are used as the communication media of the control signals of the in-room unit and the out-room unit (refer to Patent Document 1).

Patent Document 1: JP-A-6-2880 (claim 1, and FIGS. 1 and 2)

DISCLOSURE OF THE INVENTION

Problems that the Invention is to Solve

The prior-art airconditioning equipment, however, has been problematic in that the refrigerant pipes serving as the communication media and the in-room unit as well as the out-room unit need to be insulated, and that an apparatus configuration becomes large-scaled and complicated.

Especially, even when the transmission scheme of the prior-art airconditioning equipment is to be applied to an existing airconditioning equipment, an insulation work has been very difficult and complicated, and hence, the application has been actually next to impossible.

Besides, when the prior-art transmission method is to be applied to an airconditioning equipment already installed in a building or a house, the refrigerant pipes serving as the communication media and the in-room unit as well as the out-room unit need to be insulated, so that steel pipes near both the ends of each refrigerant pipe have been inevitably replaced with the electrical insulation devices.

Further, when the refrigerant pipe becomes long as in a building airconditioning system, electrical noise might mix from pipe support portions, etc., so that also parts other than both the ends have been inevitably subjected to electrical insulation treatments.

The present invention has been made in order to solve such problems, and it has for its object to provide an airconditioning equipment in which the signal transmissions between devices inside and outside a room are performed by a very simple configuration. Another object is to provide a signal transmission method which can utilize an existing pipe as a communication medium easily without involving any difficult and laborious work.

Means for Solving the Problems

An airconditioning equipment according to the present invention consists in an airconditioning equipment having an in-room unit which is connected to one end of a refrigerant pipe, and an out-room unit which is connected to the other end of the refrigerant pipe, characterized by comprising signal coupling portions which are respectively disposed at both end parts of the refrigerant pipe, and each of which couples an AC control signal to the refrigerant pipe and exhibits a predetermined impedance with respect to an AC electric signal.

Advantages of the Invention

The airconditioning equipment according to the present invention is provided with the signal coupling portions at both the end parts of the refrigerant pipe, respectively, so that a transmission line exhibiting the predetermined impedance with respect to the AC electric signal can be formed in the refrigerant pipe. As a result, the electrical insulation devices as in the prior art are dispensed with, to bring forth the excellent advantage that the signal transmissions between the in-room unit and the out-room unit can be performed by the simple apparatus configuration.

Besides, an existing refrigerant pipe can be utilized as a communication medium merely by attaching the signal coupling portions each of which consists of, for example, an annular core and a connection terminal, to the refrigerant pipe. As a result, there is brought forth the excellent advantage that the existing refrigerant pipe can be utilized as the communication medium, without the work of replacing the steel pipes near both the end of the refrigerant pipe, with the electrical insulation devices.

BEST MODE FOR CARRYING OUT THE INVENTION

Embodiment 1

FIG. 1 is a block diagram showing the configuration of an airconditioning equipment according to this embodiment.

Referring to the figure, an out-room unit 1 and an in-room unit 2 are connected through a gas-side refrigerant pipe 3 and a liquid-side refrigerant pipe 4 with an outer wall 10 interposed therebetween.

The in-room unit 2 is configured of an in-room unit refrigerant circuit 8, an in-room unit control circuit 9 and a signal coupling circuit (signal coupling portion) 7. Besides, the in-room unit control circuit 9 exchanges control signals through AC signals, and the AC control signal outputted from the in-room unit control circuit 9 is transmitted to the out-room unit via the signal coupling circuit 7 and through the medium/media of the gas-side refrigerant pipe 3 or/and the liquid-side refrigerant pipe 4.

The out-room unit 1 is configured of an out-room unit refrigerant circuit 5, an out-room unit control circuit 6 and a signal coupling circuit (signal coupling portion) 7. Besides, the out-room unit control circuit 6 exchanges control signals through AC signals likewise to the in-room unit control circuit 9, and the AC control signal outputted from the out-room unit control circuit 6 is coupled to the gas-side refrigerant pipe 3 or/and the liquid-side refrigerant pipe 4 via the signal coupling circuit 7 and is transmitted to the in-room unit 2.

FIG. 2A is a block diagram showing the principle of the signal coupling circuit according to this embodiment. Here, the out-room unit 1 will be described by way of example. The out-room unit refrigerant circuit 5 is made of a metal material, and the liquid-side pipe 3 and the gas-side pipe are electrically short-circuited through the out-room unit refrigerant circuit 5. As shown in FIG. 2B, each of the liquid-side pipe 3 and the gas-side pipe 4 is inserted through the central part of an annular core made of a magnetic material, whereby an inductance which is "1" in the number of turns is constructed. In case of, for example, a toroidal core having an inner radius R1, an outer radius R2, a height h and a permeability a self-inductance L is:

$L=(\mu h/2\pi)\ln(R2/R1)$, and it has an impedance of:

$Z=j2\pi fL$ with respect to the AC signal of frequency f. Accordingly, a transmission line which is terminated with an impedance of 2*Z is formed on the side of the out-room unit refrigerant circuit 5 under the action of the cores 11 through which the liquid-side pipe 3 and the gas-side pipe 4 are penetrated, with respect to the AC control signal transmitted by the out-room unit control circuit 6.

FIG. 3 is a view showing a coupling clamp 12 which is a practicable example of the signal coupling circuit 7. The coupling clamp 12 includes partial core pieces 11*a* into which the annular core 11 is halved along its center axis, and a connection terminal 13 which couples the AC control signal from the out-room unit control circuit 6. Besides, the connection terminal includes a metallic contact portion 13*a* which is disposed at the pipe insertion part of one end face of the partial core piece 11*a* in the longitudinal direction thereof, and a connection portion 13*b* for connecting the AC control signal of the out-room unit control circuit 6.

The coupling clamp 12 is constructed so as to be openably closed, and it is closable in a state where the partial core pieces 11*a* are combined, as shown in FIG. 4. On this occasion, the metal part of the liquid-side pipe 3 or the gas-side pipe 4 is held between the central parts of the partial core pieces 11*a*, whereby the inductance described with reference to FIG. 2A is formed. Besides, the connection portion 13*b* of the coupling clamp 12 serves as a portion for the injection of the AC control signal into the corresponding pipe.

FIG. 5 is a view showing the pipe connection part of the out-room unit 1, and it shows a practicable example in which the AC control signals are coupled to the liquid-side pipe 3 and the gas-side pipe 4 by employing the coupling clamps 12 as shown in FIG. 3. As shown in FIG. 5, the liquid-side pipe 3 and the gas-side pipe 4 are connected to the out-room unit 1 in the same manner as in the airconditioning equipment explained in the prior art, and the coupling clamps 12 electrically connected to control signal cables 16 from the out-room unit control circuit 6 are mounted on the metal parts of the liquid-side pipe 3 and the gas-side pipe 4 so as to cover them, whereby the signal coupling circuit 7 shown in FIG. 1 is formed.

The liquid-side pipe 3 and the gas-side pipe 4 connected to the out-room unit refrigerant circuit 5 are covered with a heat insulator made of an electrically insulating material such as foamed urethane, and they are laid to the in-room unit 2. Likewise, as shown in FIG. 1, the coupling clamps 12 are also mounted on the pipe connection parts of the in-room unit refrigerant circuit 8 of the in-room unit 2 so as to cover the pipes, by the same method as for the out-room unit 1, whereby the signal coupling circuit 7 is formed.

In this manner, the coupling clamps are mounted on the liquid-side pipe 3 and the gas-side pipe 4, thereby to form parallel lines which are insulated from each other and each of which has both its ends terminated with the predetermined impedance AC-wise. The out-room unit control circuit and the in-room unit control circuit 9 transmit and receive the control signals to and from each other through the lines, and the out-room unit 1 and the in-room unit 2 execute airconditioning operations in a pair.

As described above, according to this scheme, the refrigerant piping work of an airconditioner need not be altered from the method of the prior art at all, and it is permitted to use the refrigerant pipes as the transmission lines, easily by merely mounting the coupling clamps 12, so that the airconditioning equipment which is of good construction work property and which dispenses with a control wiring work can be realized.

Embodiment 2

Next, an airconditioning equipment according to Embodiment 2 will be described. FIGS. 6A and 6B are block diagrams showing the principle of a signal coupling circuit 7 according to Embodiment 2. Incidentally, constituent parts identical or equivalent to those of Embodiment 1 are assigned the same reference numerals and signs, and they shall be omitted from description.

In FIG. 6A, an out-room unit 1 will be described by way of example. An out-room unit refrigerant circuit 5 is made of a metal material, and it is electrically connected with the earth-wire connection terminal of the out-room unit 1. Accordingly, a liquid-side pipe 3 and a gas-side pipe 4 are electrically connected to the earth-wire connection terminal through the out-room unit refrigerant circuit 5. Besides, in general, the out-room unit 1 has been subjected to an earth-wire work. Even when a signal is directly coupled to the liquid-side pipe 3 or the gas-side pipe 4 in this state left intact, a coupling loss is heavy for a low earth impedance, and the propagation of the signal to the pipe cannot be expected.

As shown in FIG. 6B, each of the liquid-side pipe 3 and the gas-side pipe 4 is inserted through the central part of an annular core 11 made of a magnetic material, whereby an inductance which is "1" in the number of turns is constructed. In case of, for example, a toroidal core having an inner radius R1, an outer radius R2, a height h and a permeability μ, a self-inductance L is:

$L=(\mu h/2\pi)\ln(R2/R1)$, and it has an impedance of:

$Z=j2\pi fL$ with respect to the AC signal of frequency f. Accordingly, a transmission line which is earthed with an impedance of Z is formed on the side of the out-room unit refrigerant circuit 5 under the action of the core 11 through which the liquid-side pipe 3 or the gas-side pipe 4 is penetrated, with respect to the AC control signal transmitted by an out-room unit control circuit 6.

FIG. 7 is a view showing the pipe connection part of the out-room unit 1, and it shows a practicable example in which the AC control signal is coupled to the liquid-side pipe 3 or the gas-side pipe 4 by employing the coupling clamp 12 shown in FIG. 3. For the brevity of the description, the signal shall be coupled to the gas-side pipe 4. As shown in FIG. 7, the liquid-side pipe and the gas-side pipe 4 are connected to the out-room unit 1 in the same manner as in the airconditioning equipment explained in the prior art, and the coupling clamp 12 electrically connected to the center conductor of a control-signal coaxial cable from the out-room unit control circuit 6 is mounted on the metal part of the gas-side pipe 4 so as to cover it. Besides, the outer conductor of the control-signal coaxial cable 17 is connected to a wave excitation portion 18 which covers the surface of the heat insulator of the gas-side pipe 4 a predetermined width by using an electrically-conductive material. Thus, the signal coupling circuit 7 shown in FIG. 1 is formed.

Likewise, as shown in FIG. 1, the coupling clamp 12 is also mounted on the pipe connection part of the refrigerant circuit 8 of an in-room unit 2 so as to cover the gas-side pipe 4, and the outer conductor of a control-signal coaxial cable 17 is connected to a wave excitation portion 18, by the same method as for the out-room unit 1, whereby the signal coupling circuit 7 is formed.

In such an aspect, when the AC control signal is transmitted from the out-room unit control circuit 6, an electromagnetic field is generated between the surface of the gas-side pipe 4 and the wave excitation portion 18, and the electromagnetic field is propagated through the surface layer of the gas-side pipe 4. Since the gas-side pipe has the predetermined impedance relative to the earth owing to the self-inductance of the coupling clamp 12, an excitation current is not entirely absorbed by the earth, and an injection loss is suppressed to be low.

The electromagnetic field propagated through the surface layer of the gas-side pipe 4 reaches the signal coupling circuit 7 on the side of the in-room unit 2, to generate an electric signal in the control-signal coaxial cable 17 which is connected to the wave excitation portion 18 and the coupling clamp 12. An in-room unit control circuit 9 receives the electric signal, whereby a communication is performed. A communication from the in-room unit 2 to the out-room unit 1 is similarly performed with the operations of transmission and reception reversed.

As described above, according to this scheme, the refrigerant piping work of an airconditioner need not be altered from the method of the prior art at all, and it is permitted to use the refrigerant pipe as the transmission line, easily by merely mounting the coupling clamps 12 and mounting the wave excitation portions 18 on the pipe surfaces, so that the airconditioning equipment which is of good construction work property and which dispenses with a control wiring work can be realized.

Besides, although the case of coupling the AC control signal to the gas-side pipe 4 has been described in this embodiment, the same advantage can be attained even when a signal or signals is/are coupled to the liquid-side pipe 3 or both the pipes.

FIG. 8 is a view showing the pipe connection part of the out-room unit 1, and it shows a second practicable example in which the AC control signal is coupled to the liquid-side pipe 3 or the gas-side pipe by employing the coupling clamp 12 shown in FIG. 3. For the brevity of the description, the signal shall be coupled to the gas-side pipe 4. As shown in FIG. 8, the liquid-side pipe 3 and the gas-side pipe are connected to the out-room unit 1 in the same manner as in the airconditioning equipment explained in the prior art, and the coupling clamp 12 electrically connected to the center conductor of a control-signal coaxial cable 17 from the out-room unit control circuit 6 is mounted on the metal part of the gas-side pipe 4 so as to cover it. Besides, the outer conductor of the control-signal coaxial cable 17 is connected to the out-room unit refrigerant circuit 5. Thus, the signal coupling circuit 7 is formed.

Likewise, the coupling clamp 12 is also mounted on the pipe connection part of the refrigerant circuit 8 of an in-room unit 2 so as to cover the gas-side pipe 4, and the outer conductor of a control-signal coaxial cable 17 is connected to an in-room unit refrigerant circuit 8, by the same method as for the out-room unit 1, whereby the signal coupling circuit 7 is formed.

In general, the in-room unit 2 is disposed in such a way that it is suspended from the building structure member 19 (steel skeleton or the like) of a ceiling by a metallic anchor or the like. Besides, the out-room unit 1 is earthed through the building structure member 19, or its earth wire and the structure member are coupled by electrostatic coupling or the like. As shown in FIG. 9, accordingly, there is formed a transmission line which has the building structure 19 as a common line and which employs the gas-side pipe 4 terminated with the impedance of the coupling clamp 12, as an electric wire.

In such an aspect, the loop of an electric signal is formed by the gas-side pipe 4, coupling clamp 12 and building structure 19, so that when the AC control signal is transmitted from the out-room unit control circuit 6, this AC control signal is transmitted to the in-room unit 2 through the gas-side pipe 4. An in-room unit control circuit 9 receives the AC control signal, whereby a communication is performed. A communication from the in-room unit 2 to the out-room unit 1 is similarly performed with the operations of transmission and reception reversed.

As described above, according to this scheme, the refrigerant piping work of an airconditioner need not be altered from the method of the prior art at all, and it is permitted to use the refrigerant pipe as the transmission line, easily by merely mounting the coupling clamp 12, so that the airconditioning equipment which is of good construction work property and which dispenses with a control wiring work can be realized.

Besides, although the case of coupling the AC control signal to the gas-side pipe 4 has been described in this embodiment, the same advantage can be attained even when a signal or signals is/are coupled to the liquid-side pipe 3 or both the pipes.

Embodiment 3

Next, an airconditioning equipment according to Embodiment 3 will be described. FIG. 10 is a block diagram showing the principle of a signal coupling circuit 7 according to Embodiment 3. Incidentally, constituent parts identical or equivalent to those of Embodiment 1 are assigned the same reference numerals, and they shall be omitted from description.

In FIG. 10, an out-room unit 1 will be described by way of example. An out-room unit refrigerant circuit 5 is made of a metal material, and a liquid-side pipe 3 and a gas-side pipe 4 are electrically short-circuited through the out-room unit refrigerant circuit 5. Assuming that the out-room unit refrigerant circuit 5 is a short-circuiting terminator (refrigerant-pipe derivation portion), and that the liquid-side pipe 3 and the gas-side pipe 4 are parallel lines, an impedance at a distance l from the short-circuiting terminator varies in a range of 0-∞ depending upon the distance l, in principle as seen from formulas and a graph indicated in FIGS. 11 and 12. By way of example, when the distance l is chosen to be ¼ of the wavelength of an AC control signal for use, the impedance becomes infinity, and the gas-side pipe 4 and the liquid-side pipe 3 can be regarded as insulated wire lines. Here, in case of employing a frequency of 1 GHz, the wavelength thereof is 30 cm, and hence, the distance l from the short-circuiting terminator may be set at 7.5 cm.

FIG. 13 is a view showing the pipe connection part of the out-room unit 1, and it shows an example in which the illustration of FIG. 10 is concretized. The distance l is coupled to the liquid-side pipe 3 and the gas-side pipe 4 at ¼ of the wavelength in accordance with the frequency of the AC control signal, whereby both the pipes can be used as transmission lines.

An out-room control circuit 6 and an in-room unit control circuit 9 transmit and receive the control signals each other through the lines, and the out-room unit and an in-room unit 2 execute airconditioning operations in a pair.

As described above, according to this scheme, the refrigerant piping work of an airconditioner need not be altered from the method of the prior art at all, and it is permitted to use the refrigerant pipes as the transmission lines, easily by merely coupling the AC control signals at the distance of ¼ of the wavelength of the signals from the out-room unit refrigerant circuit 5, so that the airconditioning equipment which is of good construction work property and which dispenses with a control wiring work can be realized.

Incidentally, the single frequency is supposed here, but even when the frequency band of each control signal has a predetermined bandwidth, some communication schemes are capable of absorbing transmission line characteristics dependent upon frequencies, and the distance of a feed point may well be set at substantially ¼ wavelength in the frequency band for use.

Further, although the case of one out-room unit 1 and one in-room unit 2 has been described, it is also allowed to adopt a configuration in which a plurality of in-room units 2 are connected to one out-room unit 1, as in a building airconditioning system (building multi-airconditioner), or vice versa. In this case, it is permitted to build a network system by utilizing refrigerant pipes.

Incidentally, although the signal transmission method using the refrigerant pipe of the airconditioning equipment has been described in Embodiments 1-3, such a signal transmission method is not restricted to the refrigerant pipe. It is allowed to employ any pipe which is made of an electrically conductive substance capable of transmitting AC electric signals. It is also allowed to utilize, for example, a water pipe, a gas pipe, the hot-water supply pipe of a hot-water supply system employing a fan coil unit or the like, or the pipe of an FF type heating apparatus. A network system can be easily built by utilizing such a pipe which is already arranged in a building or a house.

Embodiment 4

FIG. 14 is a block diagram showing the configuration of an airconditioning equipment according to this embodiment.

Referring to the figure, an in-room unit and an out-room unit 23 are connected through a gas-side refrigerant pipe 24 and a liquid-side refrigerant pipe 25 with an outer wall 21 interposed therebetween.

The in-room unit 22 is configured of an in-room unit refrigerant circuit 27, an in-room unit control circuit 28, a signal distribution circuit 29 and an indoor antenna 30. Besides, the in-room unit control circuit 28 exchanges control signals through radio waves, and the control signals (electric signals) outputted from the in-room unit control circuit 28 are transmitted to the exterior/interior of a room via the signal distribution circuit 29 and through the liquid-side refrigerant pipe 25 and the indoor antenna 30, respectively.

The out-room unit 23 is configured of an out-room unit refrigerant circuit 31, an out-room unit control circuit 32 and a coupler 33. Besides, the out-room unit control circuit 32 exchanges control signals through radio waves likewise to the in-room unit control circuit 28, and the control signals (electric signals) outputted from the out-room unit control circuit 32 are coupled to the liquid-side refrigerant pipe via the coupler 33 and are transmitted to the interior of the room. Further, a remote controller 26 exchanges manipulation signals through radio waves likewise to the in-room unit 22 and out-room unit 23, and it performs various manipulations/settings etc. for the in-room unit 22.

Next, FIG. 15 is a block diagram showing the details of the signal distribution circuit 29 within the in-room unit 22 according to this embodiment.

Referring to the figure, a distributor has the function of distributing the control signal (electric signal) outputted from the in-room unit control circuit 28, to the indoor antenna 30 and a coupler 35 at a predetermined ratio, and the function of mixing the control signals (electric signals) from the indoor antenna 30 and the coupler 35, at a predetermined ratio and then transmitting the mixed signals to the in-room unit control circuit 28.

Now, operations will be described with reference to FIGS. 14 and 15.

When the remote controller 26 is manipulated to run, a running instruction is transmitted to the in-room unit 22 as a radio wave signal (manipulation signal). The radio wave signal is received by the indoor antenna 30 of the in-room unit 22, and it is transmitted as an electric signal to the in-room unit control circuit 28 via the distributor 34 within the signal distributor 29. When the in-room unit control circuit 28 decodes the received electric signal and judges the signal to be the running command, it immediately gives the command of running to the in-room unit refrigerant circuit 27.

Concurrently, the in-room unit control circuit 28 generates the electric signal of a running command destined for the out-room unit 23, and it outputs the generated signal to the signal distribution circuit 29. The distributor 34 of the signal distribution circuit 29 distributes the electric signal to the indoor antenna 30 and the coupler 35 at the suitable ratio, for example, equally. Besides, the electric signal distributed to the coupler 35 is coupled to the liquid-side refrigerant pipe through this coupler 35.

Here will be described coupling methods for coupling the electric signal to the liquid-side refrigerant pipe 25.

The coupling methods can be broadly classified into an electrostatic coupling method and an inductive coupling method. FIGS. 16 and 17 show the constructions of the couplers 35 in the cases of adopting the electrostatic coupling method and the inductive coupling method, respectively.

As shown in FIG. 16, in the electrostatic coupling method, the electric signal is directly coupled to the liquid-side refrigerant pipe 25 via a coupling capacitor 36, and a radio wave signal generated by the coupling is propagated through the surface layer of the liquid-side refrigerant pipe 25. Besides, as shown in FIG. 17, in the inductive coupling method, when a high-frequency electric signal flows through an induction coil 37, an induced current flows through the liquid-side refrigerant pipe 25 nearby, as indicated by an arrow in the figure, whereby the signal is coupled. Besides, a radio wave signal generated by the coupling is propagated through the surface layer of the liquid-side refrigerant pipe 25.

Here, the material of the refrigerant pipe is, in general, copper, and the diameter thereof is 12.7 mm or so.

Besides, the frequency of the radio wave signal is selected from a microwave frequency band (for example, between 2 to 3 GHz). Owing to such setting, the radio wave signal is propagated through the surface layer of a depth of about 1 μm from a copper surface. The electric resistance of the refrigerant pipe on this occasion (in the microwave frequency band) is given by the following formula (1):

$$R=P\times L/S \qquad \text{Formula (1)}$$

where

R: electric resistance (Ω)

P: resistivity (Ωm)

L: length (m)

S: area ($m^2$)

Accordingly, when the electric resistance is calculated by substituting the resistivity of the copper, 17 nΩm as P and the length of the refrigerant pipe, 100 m as L into the formula, it becomes about 35Ω. Assuming the impedance of the reception side to be 50Ω, an attenuation at 100 m of the refrigerant pipe becomes about 4.6 dB.

On the other hand, in a case where the radio wave signal is propagated through a free space, it attenuates about 80 dB at the distance of 100 m. Accordingly, when both the attenuations are compared, it is understood that the former attenuation is much smaller, so the radio wave signal can be transmitted at a very low loss in this embodiment.

In this manner, according to the transmission method of this embodiment, the radio wave in the microwave frequency band is employed as the radio wave signal, and it is transmitted by the surface layer effect, so that it can be transmitted at the very low loss. As a result, even when the liquid-side refrigerant pipe 25 and the in-room unit 22 as well as the out-room unit 23 are not insulated therebetween, the radio wave signal at a sufficient level can be transmitted from the in-room unit 22 to the out-room unit 23 because loss components ascribable to the in-room unit 22 and the out-room unit 23 are also small.

More specifically, since the surface layer effect is not utilized in the prior-art transmission method, the losses ascribable to the in-room unit 22 and the out-room unit 23 are heavy, and steel pipes near both the ends of the refrigerant pipe have needed to be replaced with electrical insulation devices, whereas such a work is unnecessary in the transmission method of this embodiment.

Besides, the radio wave signal having reached the out-room unit 23 in this way is inputted as an electric signal to the out-room unit control circuit 32 via the coupler 33 which is connected to the liquid-side refrigerant pipe 25.

Here, the coupler 33 is constructed by the coupling method shown in either FIG. 16 or FIG. 17, likewise to the coupler 35 of the in-room unit 22.

When the electric signal inputted to the out-room unit control circuit 32 is decoded by this out-room unit control circuit 32 and is judged to be the running command, the out-room unit control circuit gives the command of the running to the out-room unit refrigerant circuit 31.

In this way, the running manipulation from the remote controller 26 is transmitted to the out-room unit 23 via the in-room unit and liquid-side refrigerant pipe 25, and the running operation as the airconditioning equipment can be completed.

Incidentally, the case where the radio wave signal has been transmitted from the in-room unit 22 to the out-room unit 23 through the refrigerant pipe has been described here, but the operation is similar in the reverse case, that is, a case where a radio wave signal is transmitted from the out-room unit 23 to the in-room unit 22 through the refrigerant pipe. By way of example, when any trouble has occurred in the out-room unit 23, the out-room unit control circuit portion 32 generates the electric signal of a stopping command, and it converts the generated signal into a radio wave signal and then transmits the radio wave signal to the refrigerant pipe. The radio wave signal reaches the in-room unit 22 through the refrigerant pipe, and is converted into an electric signal here. The in-room unit control circuit portion 28 having received the electric signal, immediately stops the operation of the in-room unit 22 and commands the display portion (not shown) of the in-room unit 22 to display the message of "Operation Stop" or the like.

As described above, this embodiment has been so configured that the electric signal is coupled from one of the in-room unit 22 and the out-room unit 23 to the refrigerant pipe, and that the radio wave signal generated by the coupling is transmitted to the other unit along the surface layer of the refrigerant pipe. It has therefore been permitted to realize the transmission and reception of the control signals between the in-room unit 22 and the out-room unit 23, without being affected by the outer wall, etc. and without requiring dedicated signal wiring. As a result, a construction work for the existing airconditioning is only the easy mounting work, and the difficult and laborious work of replacing the steel pipes near both the ends of the refrigerant pipe, with the electrical insulation devices is dispensed with.

Incidentally, regarding the transmission and reception of the control signals to and from another device lying within the room (in this embodiment, the remote controller has been described by way of example), when the device is constructed so as to be communicable with the same radio wave signals as the control signals of the in-room/out-room units 22 and 23, the cost of disposing a transmission/reception circuit exclusively for the remote controller, or the like can be curtailed, and the in-room unit can be configured inexpensively.

Besides, although the case of coupling the electric signal to the liquid-side refrigerant pipe 25 has been described in this embodiment, the same advantages can be attained even when a signal or signals is/are coupled to the gas-side refrigerant pipe 24 or both the liquid-side refrigerant pipe 25 and the gas-side refrigerant pipe 24.

Further, although the case of one out-room unit 23 and one in-room unit 22 has been described, it is also allowed to adopt a configuration in which a plurality of in-room units 22 are connected to one out-room unit 23, as in a building airconditioning system (building multi-airconditioner), or vice versa. In this case, it is permitted to build a network system by utilizing refrigerant pipes.

Besides, although the distribution ratio of the distributor 34 has been set so as to equally divide the signal between the coupler 35 and the indoor antenna, this distribution ratio may well be changed considering the fact that the attenuation in the refrigerant pipe transmission is lower than in the spatial transmission.

Still further, in the embodiment, the transfer of the signals using the refrigerant pipe has been described as to only the exchange of the control signals between the in-room unit 22 and the out-room unit 23, but the external network line of, for example, the Internet may well be connected to the out-room unit 23. In this case, it is permitted to remote-manipulate both or either of the in-room unit 22 and the out-room unit 23 from an external control device which is connected to the network line. The transmission of a remote manipulation signal from the out-room unit to the in-room unit 22 is performed by transmitting the signal along the surface layer of the refrigerant pipe 24 or 25 as a radio wave signal, as stated above. Owing to such a configuration, a construction work for leading in any new network line into the room is dispensed with, and the inexpensive network system of an airconditioner can be built.

Besides, as shown in FIG. 18, objects to be remote-manipulated are not restricted to the in-room unit 22 and the out-room unit 23, an information/electric appliance 40 which is connected with the in-room unit 22 by radio or wire may well be made remote-manipulatable from an external control device 41 which is connected to a network line (in this example, signals are transmitted and received through the indoor antenna 30 by radio). The information/electric appliance 40 may be, for example, a rice cooker, a washing machine, a video device or a personal computer, and the external control device 41 may be, for example, a portable telephone or a portable terminal. Owing to such a configuration, even in a case where a network environment is not built in the room, it is permitted to externally manipulate the electric appliance 40 through the in-room unit 22, and the inexpensive network system of the information/electric appliance can be built.

Incidentally, although the signal transmission method using the refrigerant pipe of the airconditioning equipment has been described in the embodiment, such a signal transmission method is not restricted to the refrigerant pipe. It is allowed to employ any pipe which is made of an electrically conductive substance capable of transmitting radio wave signals along a surface layer. It is also allowed to utilize, for example, a water pipe, a gas pipe, the hot-water supply pipe of a hot-water supply system employing a fan coil unit or the like, or the pipe of an FF type heating apparatus. A network system can be easily built by utilizing such a pipe which is already arranged in a building or a house.

Embodiment 5

Although the case where the radio wave signal having reached the in-room unit 22 along the surface layer of the refrigerant pipe is derived by the signal distribution circuit 29 has been described in Embodiment 4, the case of deriving a radio wave signal without using the signal distribution circuit 29 will be described in this embodiment.

FIG. 19 is a block diagram showing the configuration of an airconditioning equipment according to this embodiment. Parts identical or equivalent to those in FIG. 14 are assigned the same reference numerals. Points different from the configuration of FIG. 14 are that the signal distribution circuit 29 is omitted from the in-room unit 22, and that the gas-side refrigerant pipe 24 is used as a signal transmission line.

In general, the refrigerant pipe such as gas-side refrigerant pipe 24 or liquid-side refrigerant pipe 25 is made of copper, so that when a high-frequency current is caused to flow through a part of the refrigerant pipe, a radio wave is radiated from the whole pipe by the same principle as that of an antenna for radio use. To the contrary, when a radio wave is received, a high-frequency current is excited in the surface layer of the refrigerant pipe and is transmitted through the whole pipe.

In this embodiment, note has been taken of the fact that the refrigerant pipe functions as the antenna in this manner.

Now, operations will be described with reference to the figure.

A control electric signal outputted from the out-room unit control circuit 32 is coupled through the coupler 33 to the gas-side refrigerant pipe 24 which is laid up to the interior of the room. Owing to the coupling, an electromagnetic field is generated around the gas-side refrigerant pipe 24, and the gas-side refrigerant pipe 24 itself functions as an antenna element, so that a radio wave signal is radiated. The radio wave signal is received by the indoor antenna 30 of the in-room unit 22 and is converted into an electric signal, which is inputted to the in-room unit control circuit 28.

On the other hand, indoors, a high-frequency current is excited in the gas-side refrigerant pipe 24 by the electromagnetic field of a radio wave signal radiated from the indoor antenna 30 of the in-room unit 22. The high-frequency current reaches the out-room unit 23 along the surface layer of the pipe 24 and is derived as an electric signal by the coupler 33 within the out-room unit 23, and the electric signal is inputted to the out-room unit control circuit 32.

In this way, two-way communications are realized between the in-room unit 22 and the out-room unit 23.

Besides, also the remote controller and a sensor 38, include built-in radio-wave transmission/reception portions (not shown), and they exchange data such as manipulation signals and sensor signals, each other through radio waves likewise to the in-room unit 22 and the out-room unit 23.

Here, an example employing a whip antenna as the practicable construction of the indoor antenna 30 is shown in FIG. 20. Referring to the figure, when a radio wave radiated from the whip antenna crosses the gas-side refrigerant pipe 24, a high-frequency current is excited in the surface of the copper pipe part of the pipe. To the contrary, a radio wave radiated from the pipe excites a high-frequency current in the surface of the whip antenna.

Next, an example of a system architecture which employs the airconditioning equipment according to this embodiment is shown in FIG. 21.

Referring to the figure, a first in-room unit 42 and a second in-room unit 43 are connected with the out-room unit 23 through the gas-side refrigerant pipe 24 or the liquid-side refrigerant pipe 25. Besides, a first remote controller 61 is located at distances a and b (a<b) from the first in-room unit 42 and the second in-room unit 43, respectively, while a second remote controller 62 is located at distances c and d (c>d) from the first in-room unit 42 and the second in-room unit 43, respectively.

Further, the first in-room unit 42 and the second in-room unit 43 obtain data on RSSIs (Receive Signal Strength Indicators) which expresses communication qualities, for example, the strengths of signals, from the first remote controller 61 and the second remote controller 62, and they exchange the data each other.

Now, a series of operations in the system will be described with reference to FIGS. 19 and 21.

First of all, the bestowal of address Nos. on the individual equipments will be described.

An ID No. based on, for example, a floor No. is set for the out-room unit control circuit 32 of the out-room unit 23. Besides, the out-room unit control circuit 32 creates a discovery command for verifying the existence of the in-room unit 22, the remote controller 26 or the like, and it issues a command electric signal with its own ID No. affixed thereto. The issued command electric signal is coupled to the gas-side refrigerant pipe 24 by the coupler 33, and is radiated as a command radio-wave signal.

The command radio-wave signal is received by the indoor antenna 30 of the in-room unit 22 and is converted into an electric signal, which is thereafter inputted to the in-room unit control circuit 28. When the in-room unit control circuit 28 recognizes the discovery command from the inputted signal, it creates a response which contains a code for specifying the in-room unit 22, for example, the physical address of the communication portion of the in-room unit control circuit 28 and the type of the device, "in-room unit". Besides, the created response electric signal is radiated as a response radio-wave signal through the indoor antenna 30.

On the other hand, also the remote controller 26 which has received the command radio-wave signal radiated via the indoor pipe creates a response containing a code for specifying this remote controller itself and radiates the created response as a response radio-wave signal, likewise to the in-room unit 22.

The response radio-wave signals thus radiated from the in-room unit 22 and the remote controller 26 are respectively transmitted through the gas-side refrigerant pipe 24 and converted into electric signals by the coupler 33 within the out-room unit 23, and the electric signals are inputted to the out-room unit control circuit 32.

Besides, the out-room unit control circuit 32 creates a response on the basis of received response contents.

In the illustrated case, the out-room unit 23 determines address Nos. associated with the ID No. set for this out-room unit itself, for the two in-room units and 43 and the two remote controllers 61 and 62, respectively, and it records the address Nos. in an address management table and also sends back the address Nos. in accordance with the same procedure as that of the issue of the discovery command, by being affixed to the codes which are contained in the respective responses.

Incidentally, the sending-back procedure may well be such that a table in which the codes and the address Nos. are held in correspondence is transmitted as one command by broadcast or the like.

The in-room units and the remote controllers which have received the address Nos. store the given address Nos. therein, and perform communications on the basis of the address Nos. thenceforth.

Incidentally, regarding the address No. of the out-room unit 23, the ID No. itself initially set may be used, or the No. employed in distributing the address No. to the in-room unit 22, the remote controller 26, etc. may well be used.

The bestowal of the address Nos. on the devices communicable through the refrigerant pipe, such as the in-room unit 22 and the remote controller 26, is completed by the above procedure.

Next, there will be described the association between the devices, namely, between the out-room unit 23 and the in-room units 22 or between the in-room units 22 and the remote controllers 26.

First, the association between the out-room unit 23 and the in-room units 22 will be described.

The out-room unit control circuit 32 of the out-room unit 23 transmits a test running command to each individual in-room unit 22 endowed with the address No. Besides, the out-room unit control circuit detects that the control state of the out-room unit 23, for example, the flow rate of a refrigerant is changed by the running of the in-room unit, thereby to verify if the in-room unit is connected to the refrigerant circuit of the out-room unit itself.

The out-room unit control circuit bestows an identification code on the verified in-room unit, and transmits the identification code in accordance with the same procedure as that of the issue of the discovery command.

On the other hand, in a case where the connection to the refrigerant circuit of the out-room unit cannot be verified, the out-room unit control circuit displays an alarm or the like together with the foregoing code, by employing the display unit of the remote controller 26, or the like, and it thereby prompts a user to check settings.

Besides, in a case where the connection cannot be finally verified, the out-room unit control circuit notifies the corresponding in-room unit 22 of the annulment of the address No. and executes a process for excluding the address No. from the management table of the out-room unit 23.

Owing to such processing, the association between the out-room unit 23 and the in-room units 22 can be made reliable.

Subsequently, the association between the in-room units 22 and the remote controllers 26 will be described.

The out-room unit control portion 32 of the out-room unit 23 commands the first in-room unit 42 and the second in-room unit 43 to communicate with the first remote controller 61 and the second remote controller 62.

The first in-room unit 42 communicates with the first remote controller 61, and it stores therein communication quality information, for example, an RSSI signal on that occasion. Likewise, the first in-room unit 42 communicates with the second remote controller 62 and stores an RSSI signal therein. The levels of the RSSI signals based on the first remote controller 61 and the second remote controller 62 as have been received on these occasions depend on distances from the first in-room unit 42 to the respective remote controllers.

More specifically, according to the electromagnetic theory, the attenuation magnitude of a radio wave signal in a free space increases in proportion to the square of a distance, and it is given by the following formula:

$$\Gamma=(4\pi d/\lambda)^2 \qquad \text{Formula (2)}$$

where $\Gamma$: attenuation magnitude d: distance (m)

$\lambda$: wavelength (m)

Here, letting "Sa" and "Sb" denote the RSSI signal levels based on the first remote controller 61 and the second remote controller 62 as have been received by the first in-room unit 42, respectively, and letting "Sc" and "Sd" denote the RSSI signal levels based on the first remote controller and the second remote controller 62 as have been received by the second in-room unit 43, respectively, it is understood from Formula (2) that the relations of Sa>Sb and Sd>Sc hold in the case of FIG. 21, because the relations of a<b and c>d hold as regards the distances from the remote controllers to the in-room units.

The respective in-room units 22 transmit information items on the relations of the magnitudes of the RSSI signal levels, to the out-room unit 23. The out-room unit determines to associate the first remote controller 61 with the first in-room unit 42 and to associate the second remote controller 62 with the second in-room unit 43, on the basis of the pertinent information items, and it stores the association in the management table. Concurrently, the out-room unit issues identification codes to the associated out-room units and remote controllers, and it transmits the identification codes to the respective in-room units and remote controllers in accordance with the same procedure as that of the discovery command.

In this way, the association between each in-room unit 22 and the remote controller 26 arranged near this in-room unit can be made reliable.

Besides, the sensor 38 which is arranged in the room and which has communication means based on the same radio-wave signal is similarly associated with the in-room unit 22, and it is stored in the management table. Besides, the out-room unit 23 issues identification codes to the associated out-room units and sensors, and it transmits the identification codes to the respective in-room units and sensors in accordance with the same procedure as that of the discovery command.

As a result, the in-room units 22 can freely utilize the information items of the sensors 38 arranged within an air-conditioning range.

When a running manipulation is done by the first remote controller 61 after the devices have been associated in this way, a running command is radiated as a radio wave signal. The command radio-wave signal is received by the indoor antenna 30 of the first in-room unit 42 and is transmitted as a command electric signal to the in-room unit control circuit 28.

When the in-room unit control circuit 28 decodes the received signal and judges the signal to be the running command, it immediately gives the command of running to the in-room unit refrigerant circuit 27. Concurrently, the in-room unit control circuit 28 generates the electric signal of the running command destined for the out-room unit 23, and it radiates the command signal as a command radio-wave signal from the indoor antenna 30.

The command radio-wave signal is turned into an electric signal through the gas-side refrigerant pipe 24 and the coupler 33, and the electric signal is received by the out-room unit control circuit 32 of the out-room unit 23. Besides, when the out-room unit control circuit 32 decodes the received electric signal to be the running command, it immediately gives the command of running to the out-room unit refrigerant circuit 31.

In this way, it is permitted to smoothly run the in-room unit 22 and the out-room unit 23 by the manipulation of the remote controller 26.

Incidentally, here, the radio-wave signal of the running command is transmitted and received by employing the indoor antenna 30, but as shown in FIG. 22, the refrigerant pipe such as liquid-side refrigerant pipe 25 or gas-side refrigerant pipe 24 may well be utilized as an antenna element, without employing the indoor antenna 30.

In this case, an electric signal is coupled to the refrigerant pipe through the coupler 33 so as to radiate a radio wave signal from the refrigerant pipe into a space by the coupling, and a radio wave signal excited in the refrigerant pipe by the radio wave signal having arrived is extracted and is converted into an electric signal.

Besides, although the case where the command radio-wave signal has been transmitted from the in-room unit 22 to the out-room unit 23 through the refrigerant pipe has been described, the situation is similar in the reverse case, that is, a case where a command radio-wave signal is transmitted from the out-room unit 23 to the in-room unit 22 through the refrigerant pipe. By way of example, when any trouble occurs in the out-room unit 23, the out-room unit control circuit 32 creates the electric signal of a stop command. The command electric signal is coupled to the liquid-side refrigerant pipe 25 or the gas-side refrigerant pipe 24 through the coupler, and it is radiated as a command radio-wave signal. The command radio-wave signal reaches the in-room unit 22, and it is received by the indoor antenna 30 so as to be converted into a command electric signal. When the in-room unit control circuit 28 decodes the command electric signal and judges this signal to be the stop command, it immediately stops the operation of the in-room unit 22 and commands the display portion (not shown) of the in-room unit 22 to display the message of "Operation Stop" or the like. Besides, the same stop command may well be transmitted to the remote controller having the same identification code, so as to display a similar message.

In this way, even the command in the reverse direction can be smoothly transmitted, and the occurrence of the trouble can be quickly coped with.

Here will be described the practicable configurations of coupling methods for coupling an electric signal the gas-side refrigerant pipe 24.

The coupling methods as described in Embodiment 4 are broadly classified into the electrostatic coupling method and the inductive coupling method. In case of the electrostatic coupling method, the electric signal is directly coupled to the gas-side refrigerant pipe 24 via the coupling capacitor 36 as described with reference to FIG. 16. FIG. 23 shows a practicable configurational example for realizing this method, in which the core of a signal cable is connected to the gas-side refrigerant pipe through the coupling capacitor 36, and the earth wire of the signal cable is connected to a metal tape or the like which is stuck outside the heat insulator of the pipe.

Besides, in case of the inductive coupling method, as described with reference to FIG. 17, the high-frequency electric signal is caused to flow through the induction coil 37, and the induced current of high frequency flows through the gas-side refrigerant pipe 24 nearby, as indicated by the arrow in the figure, whereby the signal is coupled.

FIG. 24 shows a practicable configurational example for realizing this method, in which the induction coil 37 is in an aspect where a coil is wound round toroidal core, and the core and earth wire of a signal cable are respectively connected to one end and the other end of the coil. Besides, the refrigerant pipe is configured so as to pass through the hollow part of the toroidal core and to lie near the induction coil 37.

Still further, in most cases, the actual refrigerant pipe is surrounded with the heat insulator, for example, foamed polyethylene having a permittivity $\in>1$. Influence by the heat insulator will be described.

Let's consider a case where a radio wave signal of high frequency has been coupled to the refrigerant pipe covered with the heat insulator, through the coupler 33, and where it has been excited.

According to the electromagnetic theory, the phase velocity of an electromagnetic wave (surface wave) in and around the refrigerant pipe becomes lower than the light velocity due to the resistance of the refrigerant pipe and a dielectric substance surrounding this pipe. As a result, the amplitude of the surface wave attenuates exponentially as the refrigerant pipe becomes distant. Besides, the degree of the attenuation is determined by the electric conductivity of the refrigerant pipe and the relative permittivity of the dielectric substance.

In, for example, "University Course Microwave Engineering" published by Ohmsha, Ltd., P. 90, FIG. 127, there is indicated a trial calculation result in which, in case of a dielectric material having a relative permittivity $\in=3$, 90% of the energy of a radio wave signal at, a frequency of 3 GHz is confined within the range of a radius 15 cm from an electric conductor. As understood from the trial calculation result, with the refrigerant pipe which is surrounded with the heat insulator, radio wave energy which is radiated outwards is very little, and most of the energy concentrates in and around the refrigerant pipe. It is accordingly permitted to realize pipe transmission exhibiting a small transmission loss and being capable of far transmission, by employing such a refrigerant pipe surrounded with the heat insulator.

As described above, this embodiment is so configured that the electric signals are coupled from the in-room unit 22 and the out-room unit 23 to the refrigerant pipe so as to transmit the radio wave signals generated by the couplings, along the surface layer of the refrigerant pipe, and that the refrigerant pipe is employed as the antenna element, so as to permit the communications between the interior and exterior of the room by employing the radio waves radiated from the antenna element.

As a result, as described in Embodiment 4, the transmission losses ascribable to the in-room unit 22 and the out-room unit 23 can be reduced more than in the prior-art transmission method which does not utilize the radio waves. Moreover, the difficult and laborious work of replacing the steel pipes near both the ends of the refrigerant pipe, with the electrical insulation devices is dispensed with, and the existing refrigerant pipe can be utilized as the excellent signal transmission line by the simple work.

Besides, although the case of coupling the electric signal to the gas-side refrigerant pipe 24 has been described in this embodiment, the same advantages can be attained even when a signal or signals is/are coupled to the liquid-side refrigerant pipe 25 or both the liquid-side refrigerant pipe 25 and the gas-side refrigerant pipe 24.

Further, although the system which consists of one out-room unit 23 and two in-room units 22 has been described in this embodiment, it is also allowed to adopt a configuration in which a plurality of in-room units 22 are connected to one out-room unit 23, as in a building airconditioning system (building multi-airconditioner), or conversely, a configuration in which one in-room unit 22 is connected to a plurality of out-room units 23. Further, it is allowed to adopt a configuration in which a plurality of in-room units 22 are connected to a plurality of out-room units 23. It is possible to build a network system by utilizing refrigerant pipes in accordance with a similar procedure.

Still further, in this embodiment, the transfer of the signals using the refrigerant pipe has been described as to only the exchange of the control signals between the in-room unit 22 and the out-room unit 23, but the external network line of, for example, the Internet may well be connected to the out-room unit 23. In this case, as described in Embodiment 4, it is permitted to remote-manipulate both or either of the in-room unit 22 and the out-room unit 23 from an external control device which is connected to the network line. The transmission of a remote manipulation signal from the out-room unit 23 to the in-room unit 22 is performed by transmitting the signal along the surface layer of the refrigerant pipe as a radio wave signal.

Owing to such a configuration, a construction work for leading in any new network line into the room is dispensed with, and the inexpensive network system of an airconditioner can be built.

Incidentally, although the signal transmission method using the refrigerant pipe of the airconditioning equipment has been described in this embodiment, such a signal transmission method is not restricted to the refrigerant pipe. As described in Embodiment 4, it is allowed to employ any pipe which is made of an electrically conductive substance capable of transmitting radio wave signals along a surface layer. It is also allowed to utilize, for example, a water pipe, a gas pipe, the hot-water supply pipe of a hot-water supply system employing a fan coil unit or the like, or the metallic pipe of an FF type heating apparatus. A network system can be easily built by utilizing such a pipe which is already arranged in a building or a house.

DESCRIPTION OF REFERENCE NUMERALS AND SIGNS

Figure 1:
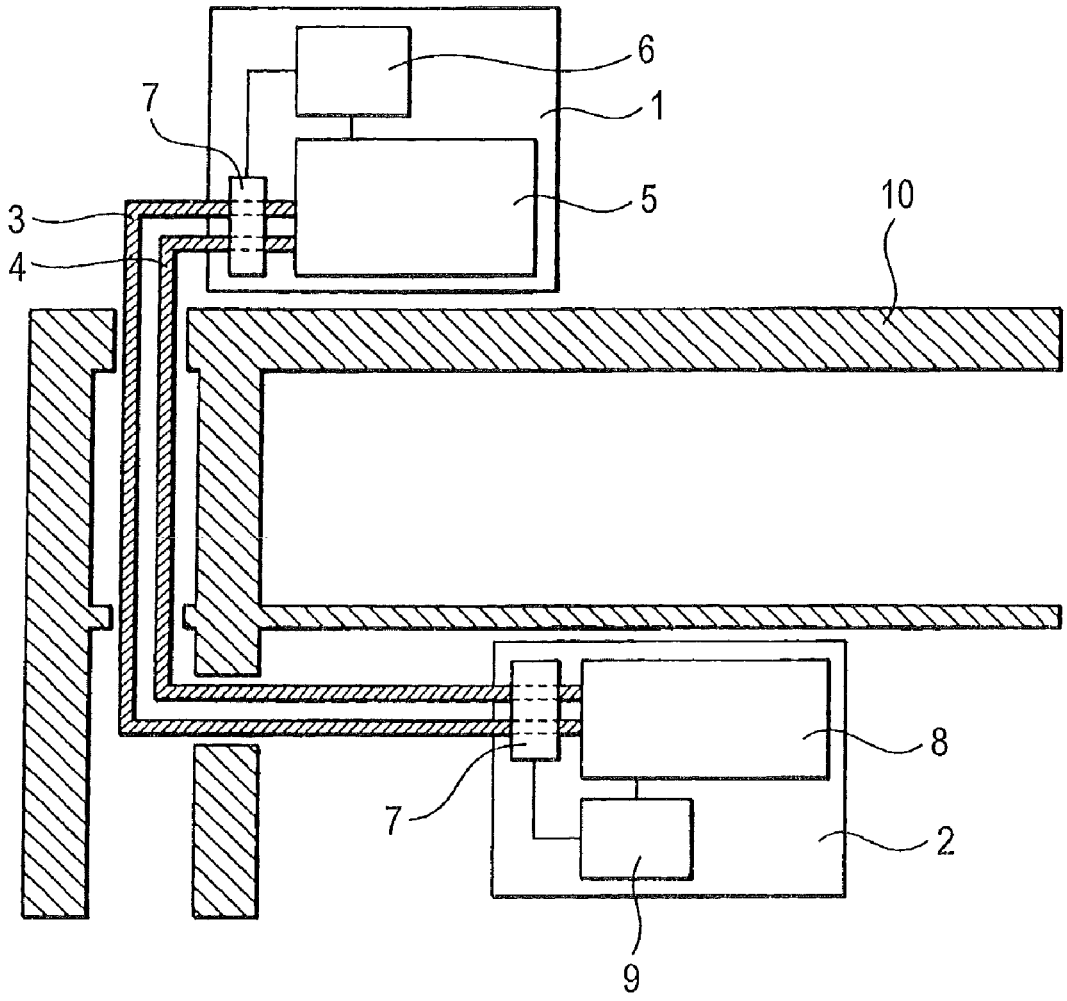
FIG. 1 is a block diagram showing the configuration of an airconditioning equipment according to Embodiment 1.
Figure 2A:
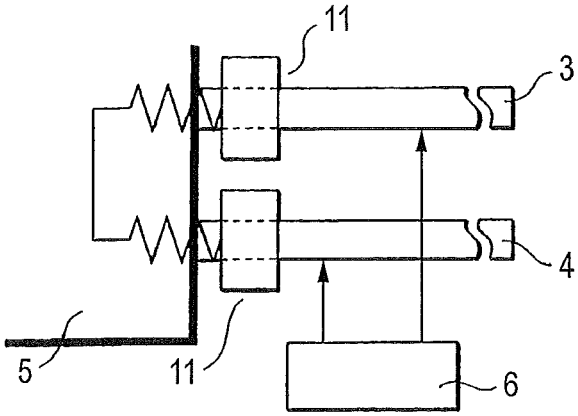
FIG. 2A is a block diagram showing the principle of a signal coupling circuit according to Embodiment 1.
Figure 2B:
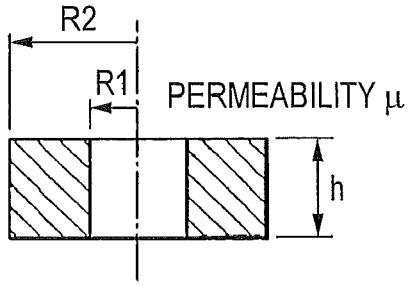
FIG. 2B is a sectional view showing the structure of a core.
Figure 3:
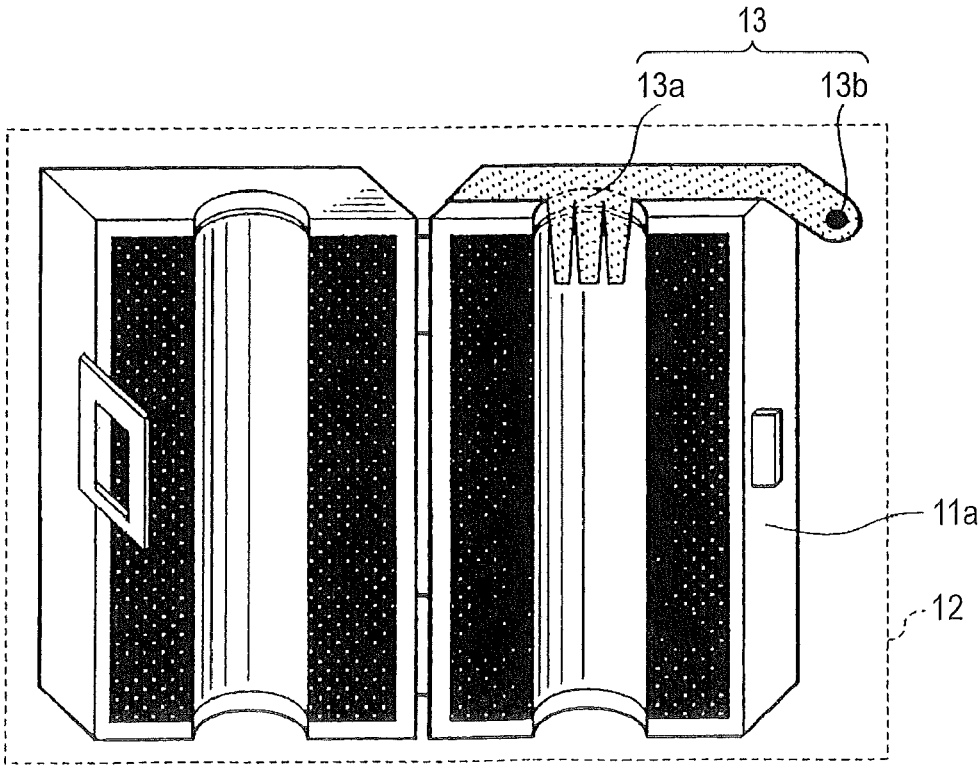
FIG. 3 is a view showing the structure of a coupling clamp according to Embodiment 1.
Figure 4:
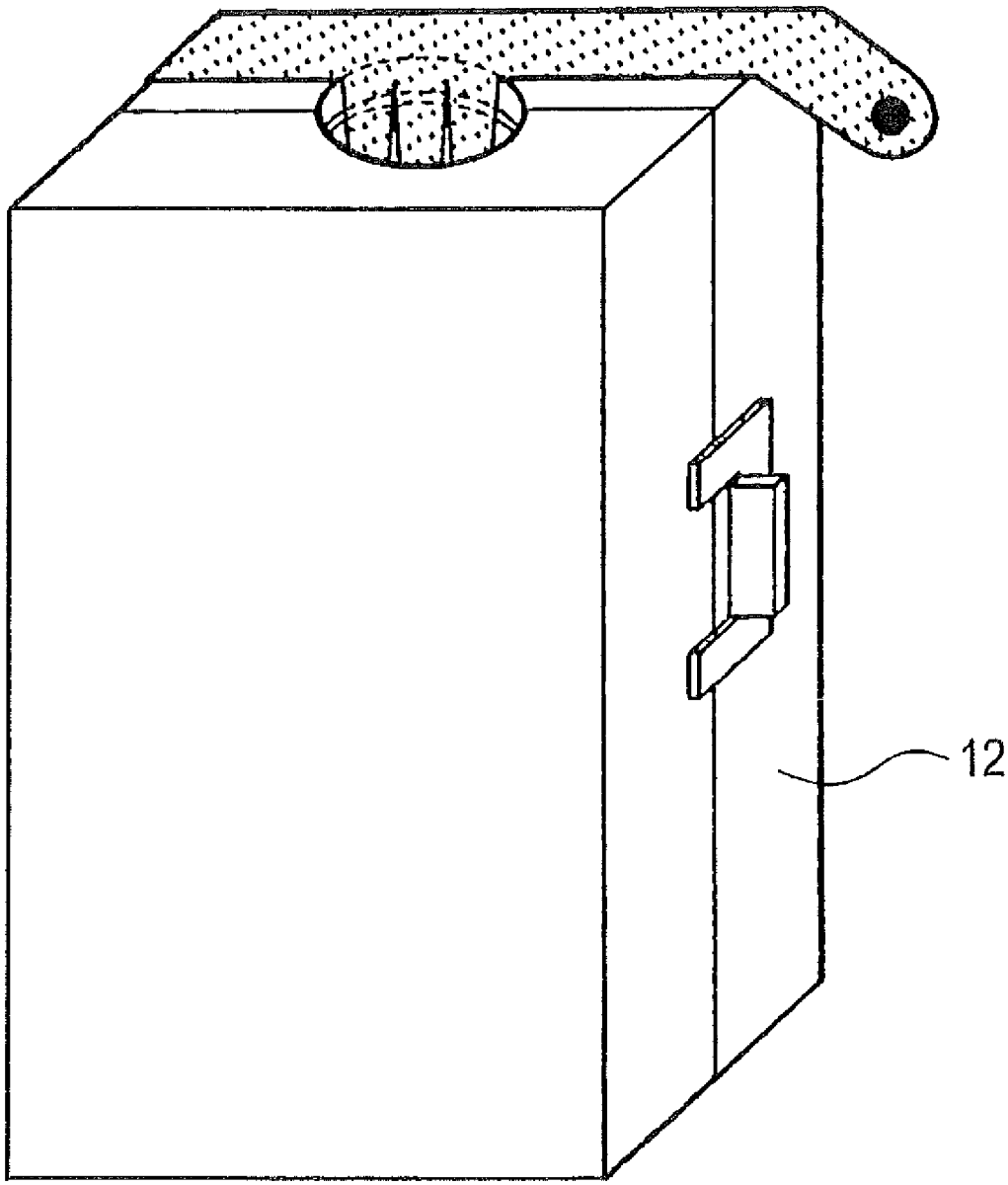
FIG. 4 is a view showing a state where the coupling clamp according to Embodiment 1 is closed.
Figure 5:
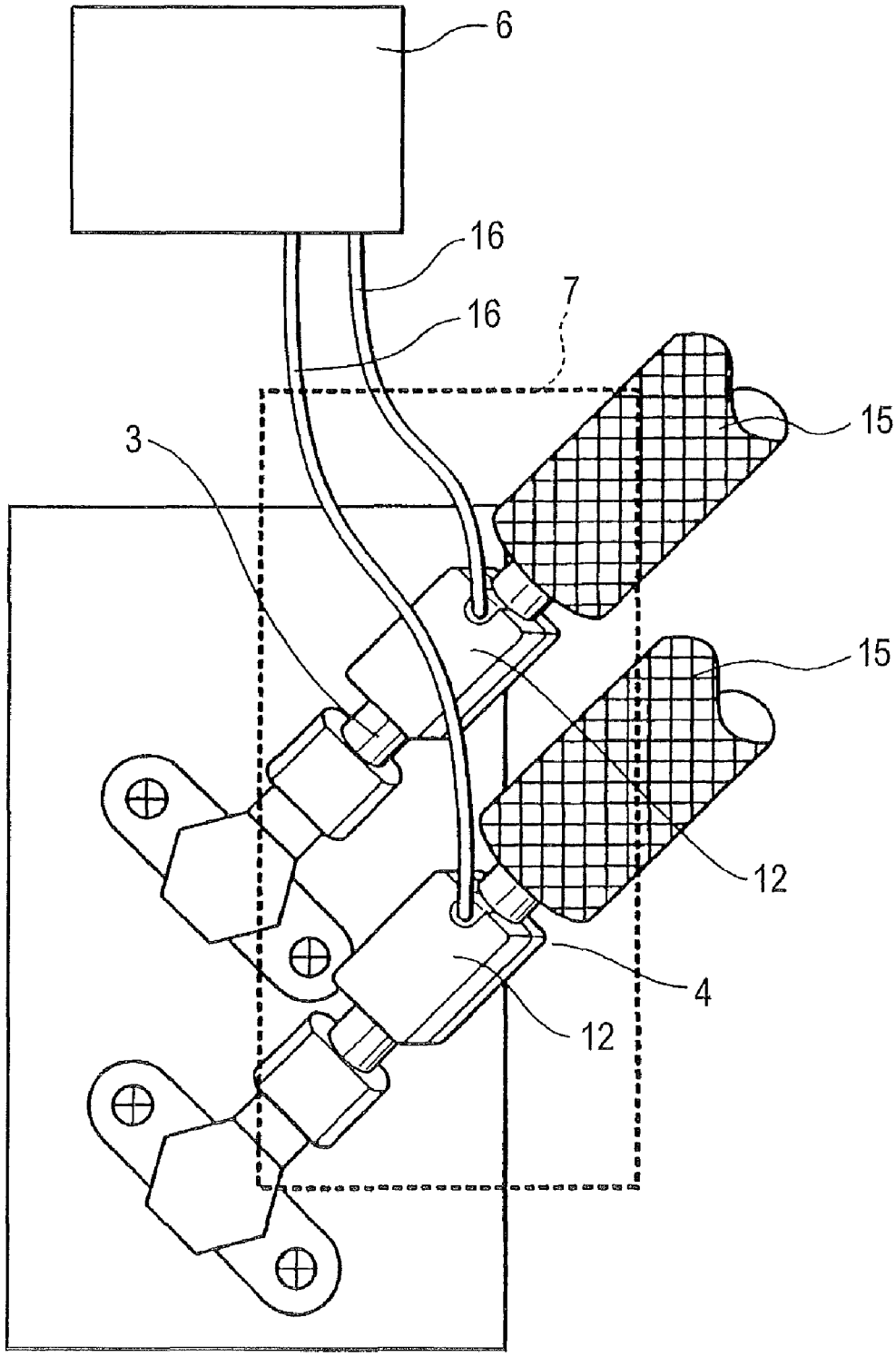
FIG. 5 is a view showing a practicable example of the signal coupling portion according to Embodiment 1.
Figure 6A:
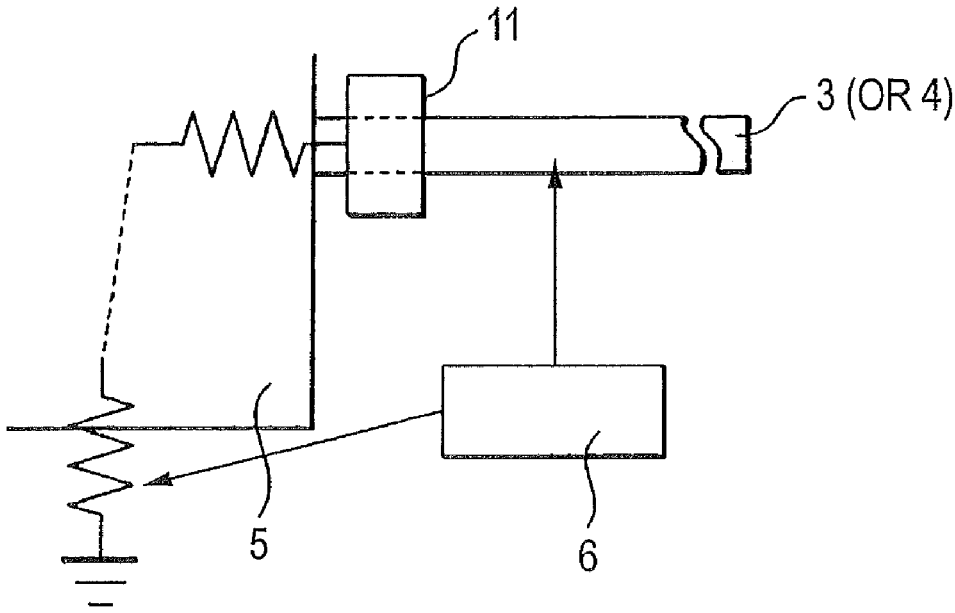
FIG. 6A is a block diagram showing the principle of a signal coupling circuit according to Embodiment 2.
Figure 6B:
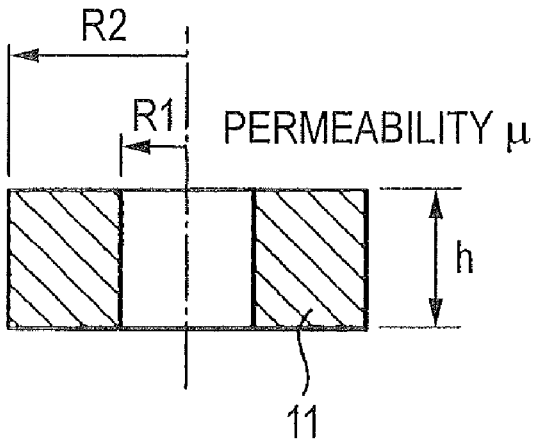
FIG. 6B is a sectional view showing the structure of a core.
Figure 7:
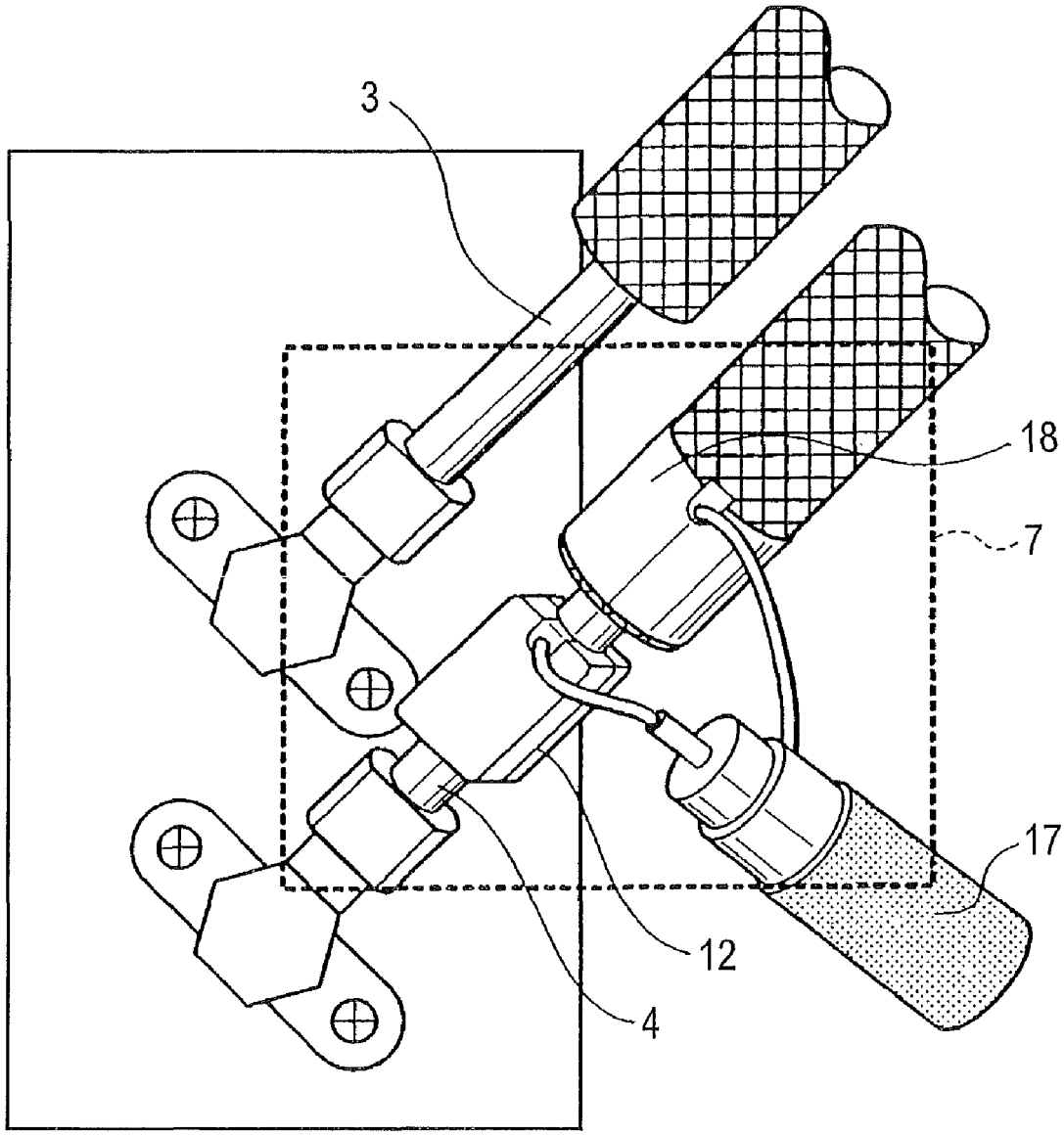
FIG. 7 is a view showing a practicable example of the signal coupling circuit according to Embodiment 2.
Figure 8:
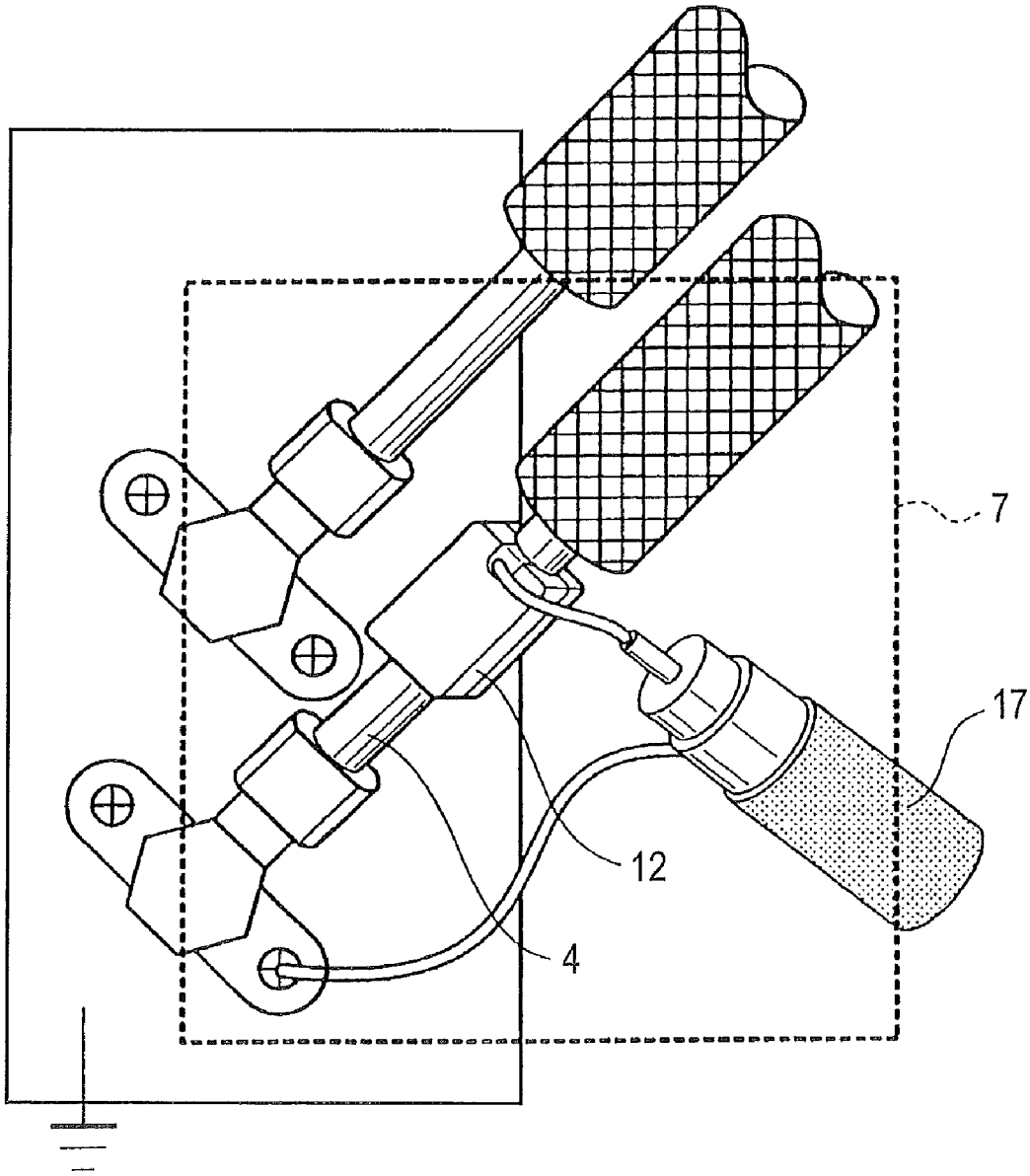
FIG. 8 is a view showing another practicable example of the signal coupling circuit according to Embodiment 2.
Figure 9:
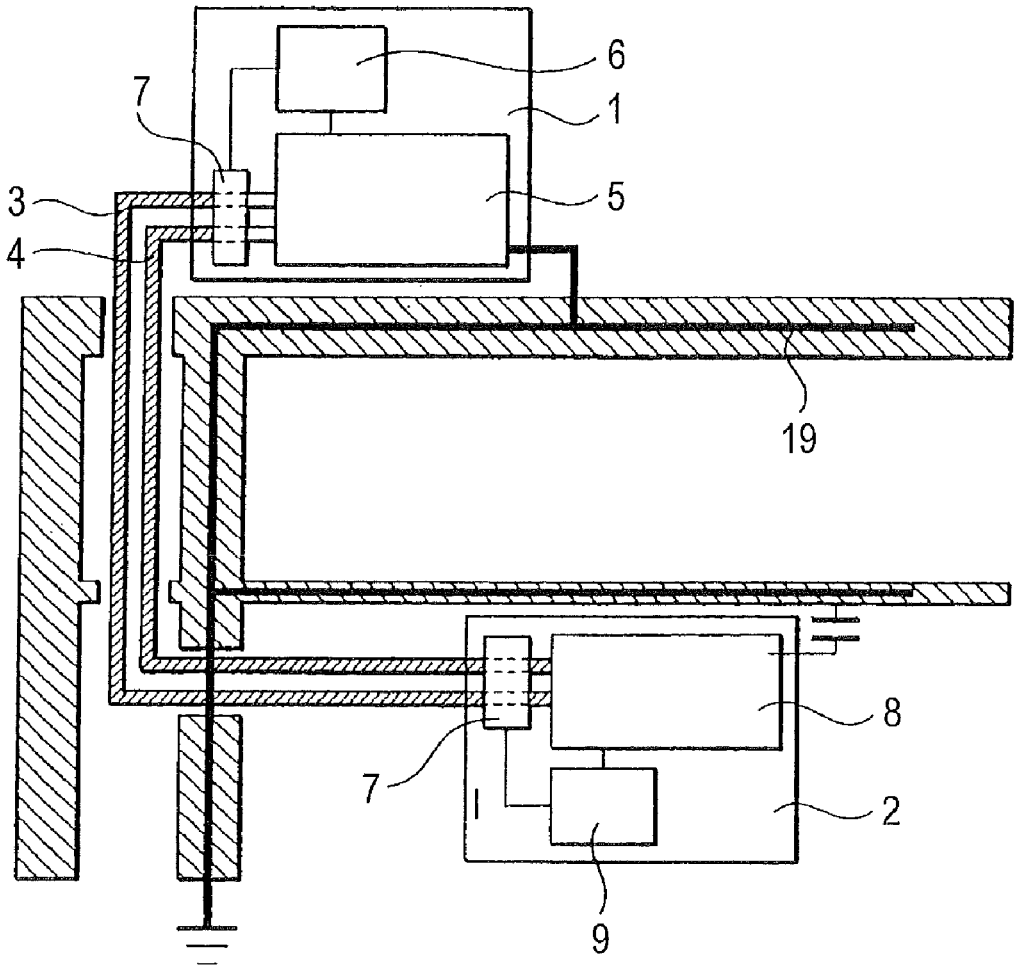
FIG. 9 is a system architecture diagram for explaining a transmission line which employs the signal coupling circuit in FIG. 8.
Figure 10:
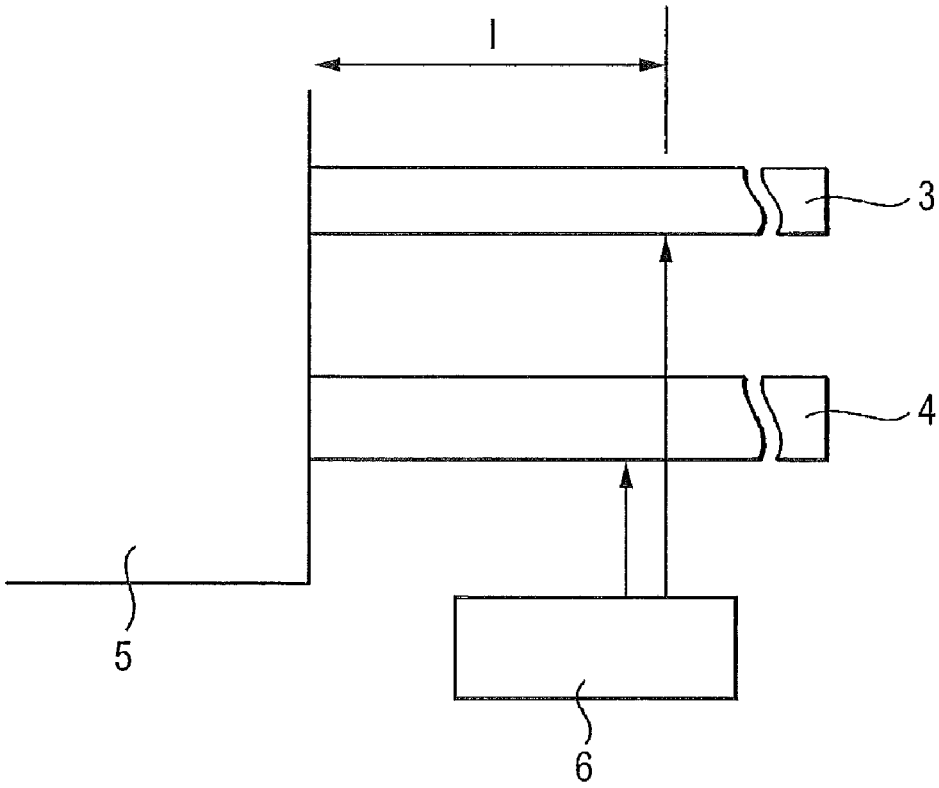
FIG. 10 is a block diagram showing the principle of a signal coupling circuit according to Embodiment 3.
Figure 11:
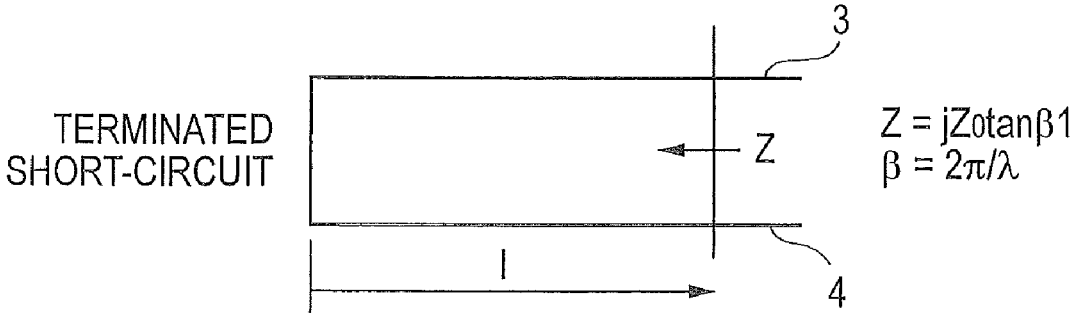
FIG. 11 is a diagram showing the end parts of a liquid-side pipe 3 and a gas-side pipe 4.
Figure 12:
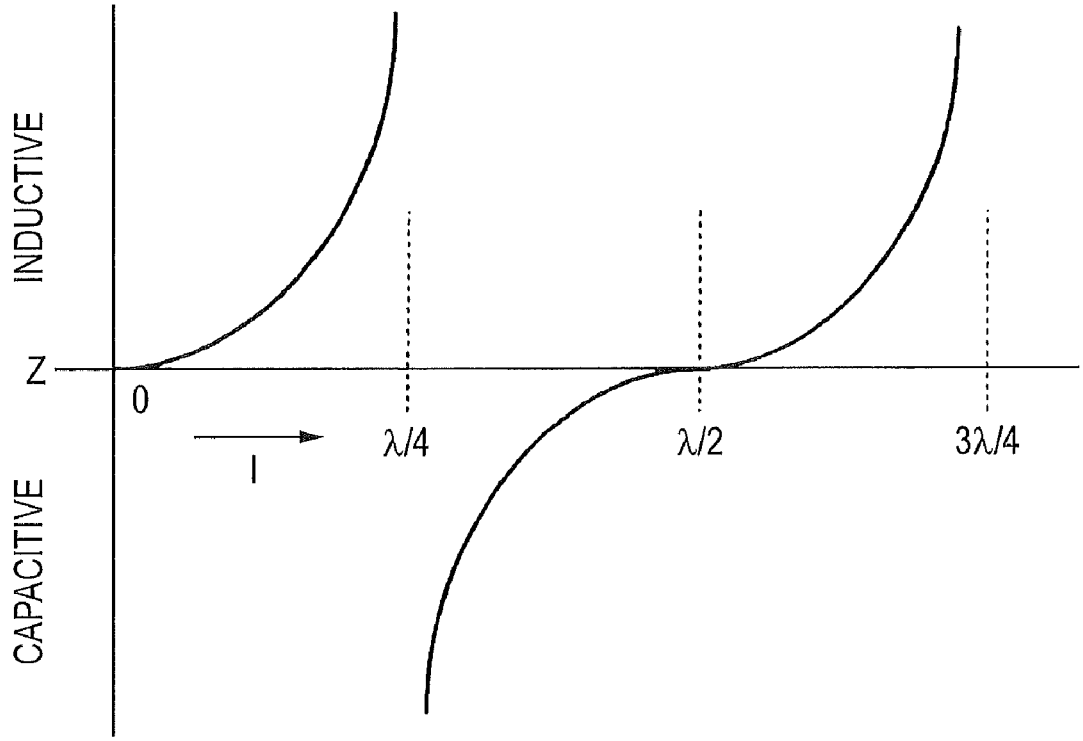
FIG. 12 is a graph showing an impedance at a distance l from a short-circuiting terminator.
Figure 13:
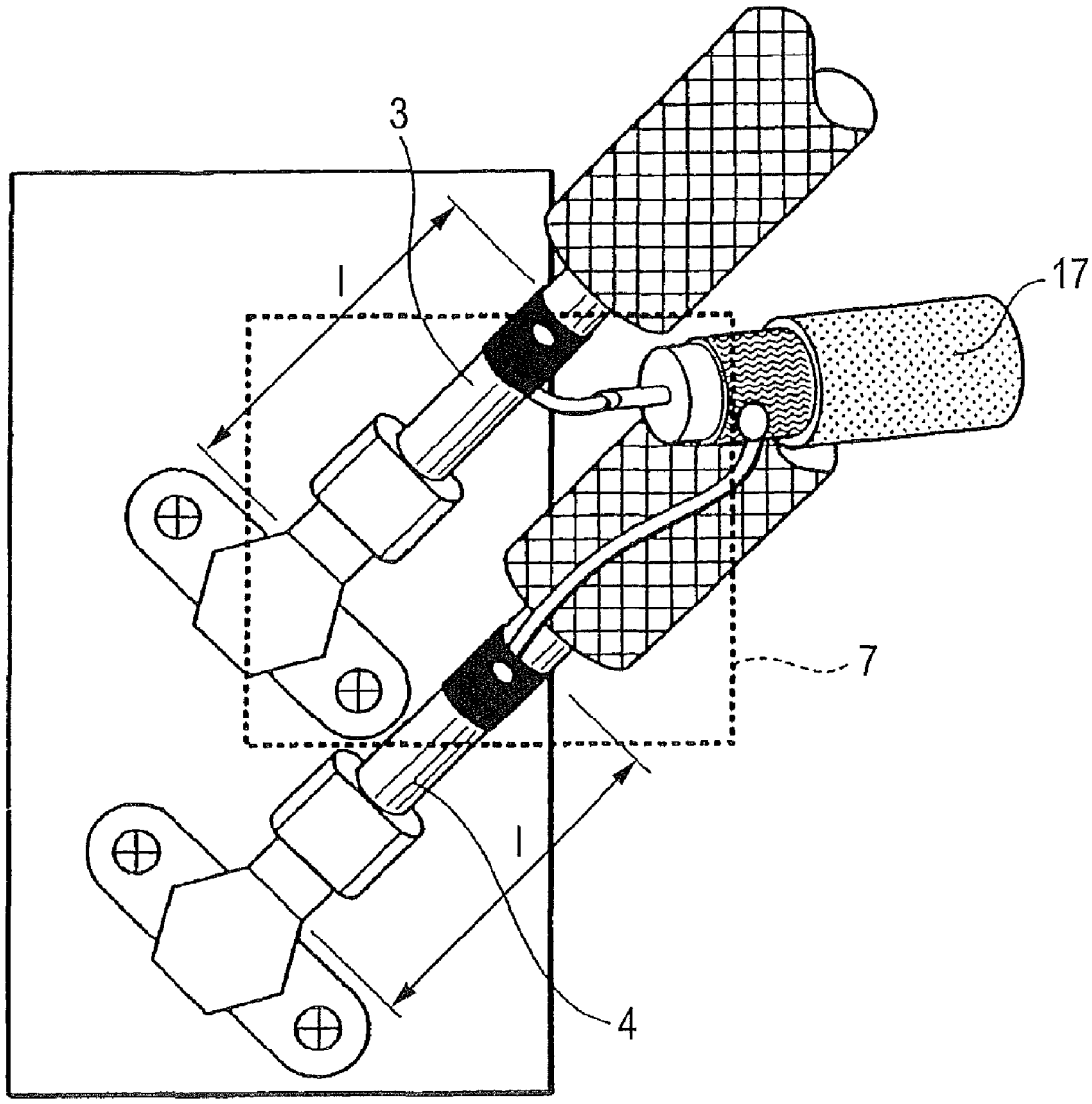
FIG. 13 is a view showing a practicable example of the signal coupling circuit according to Embodiment 3.
Figure 14:
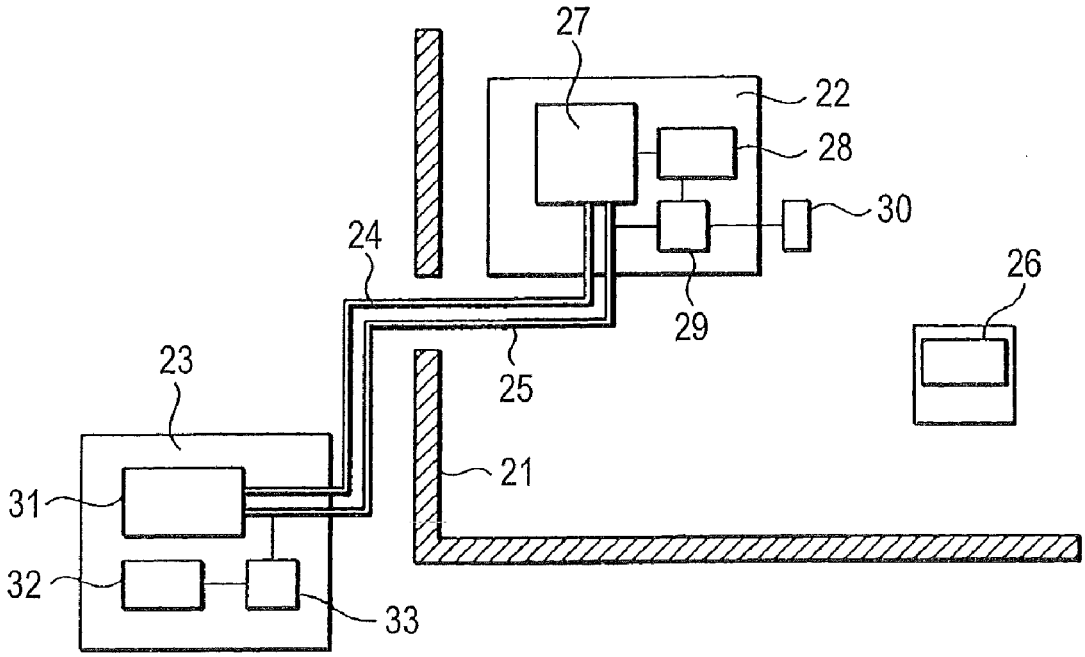
FIG. 14 is a block diagram showing the configuration of an airconditioning equipment according to Embodiment 4.
Figure 15:
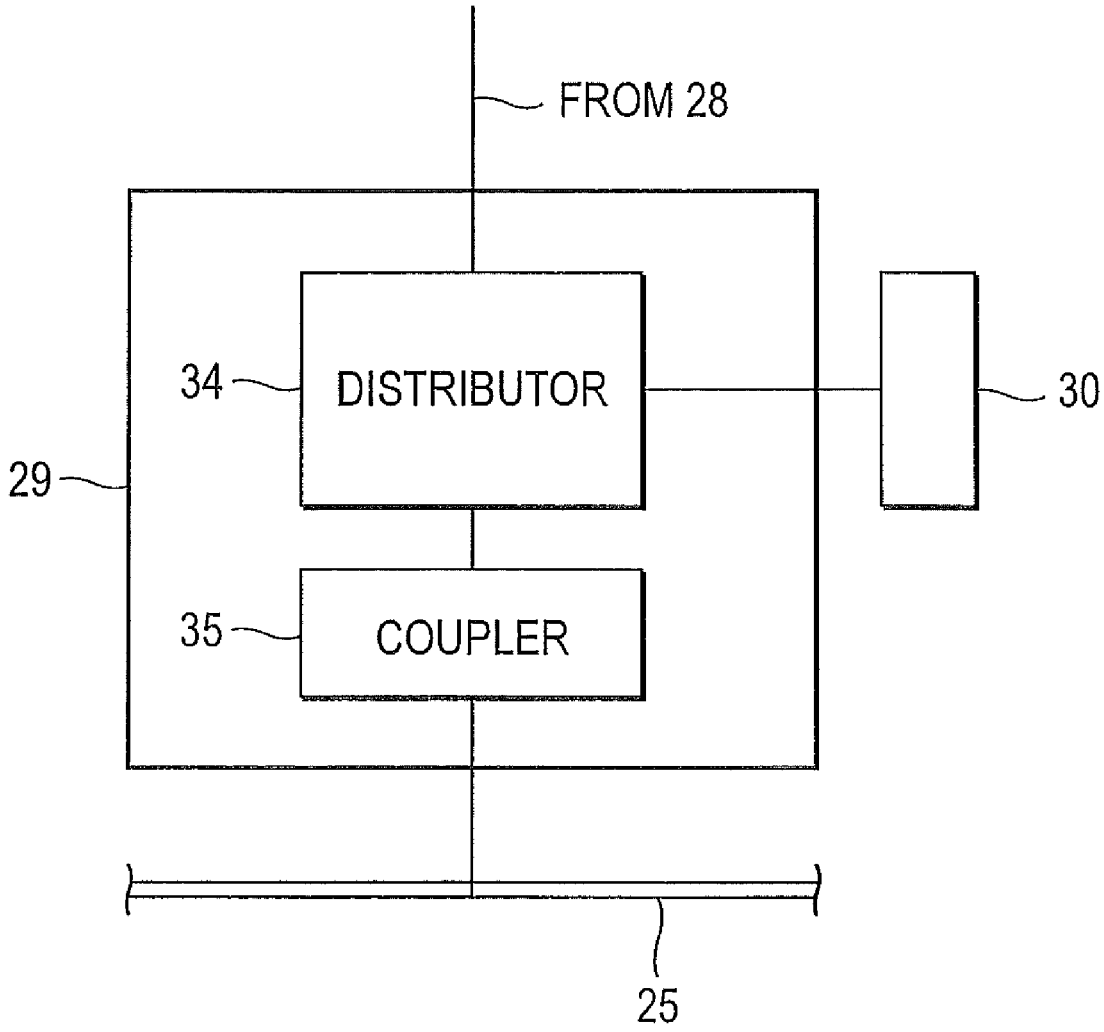
FIG. 15 is a block diagram showing the details of a signal distribution circuit within an in-room unit according to Embodiment 4.
Figure 16:
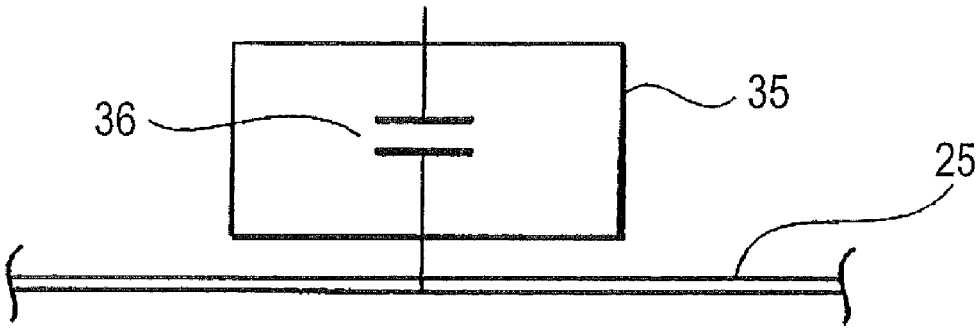
FIG. 16 is an explanatory view showing the electrostatic coupling method of a coupler according to Embodiment 4.
Figure 17:
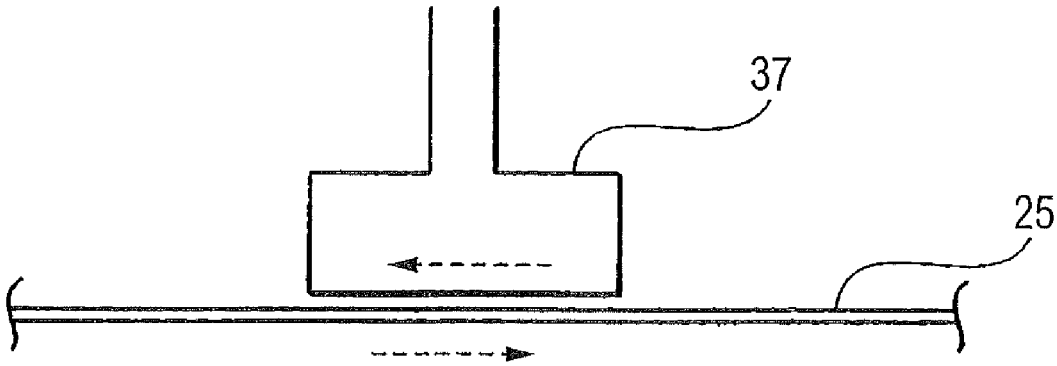
FIG. 17 is an explanatory view showing the inductive coupling method of a coupler according to Embodiment 4.
Figure 18:
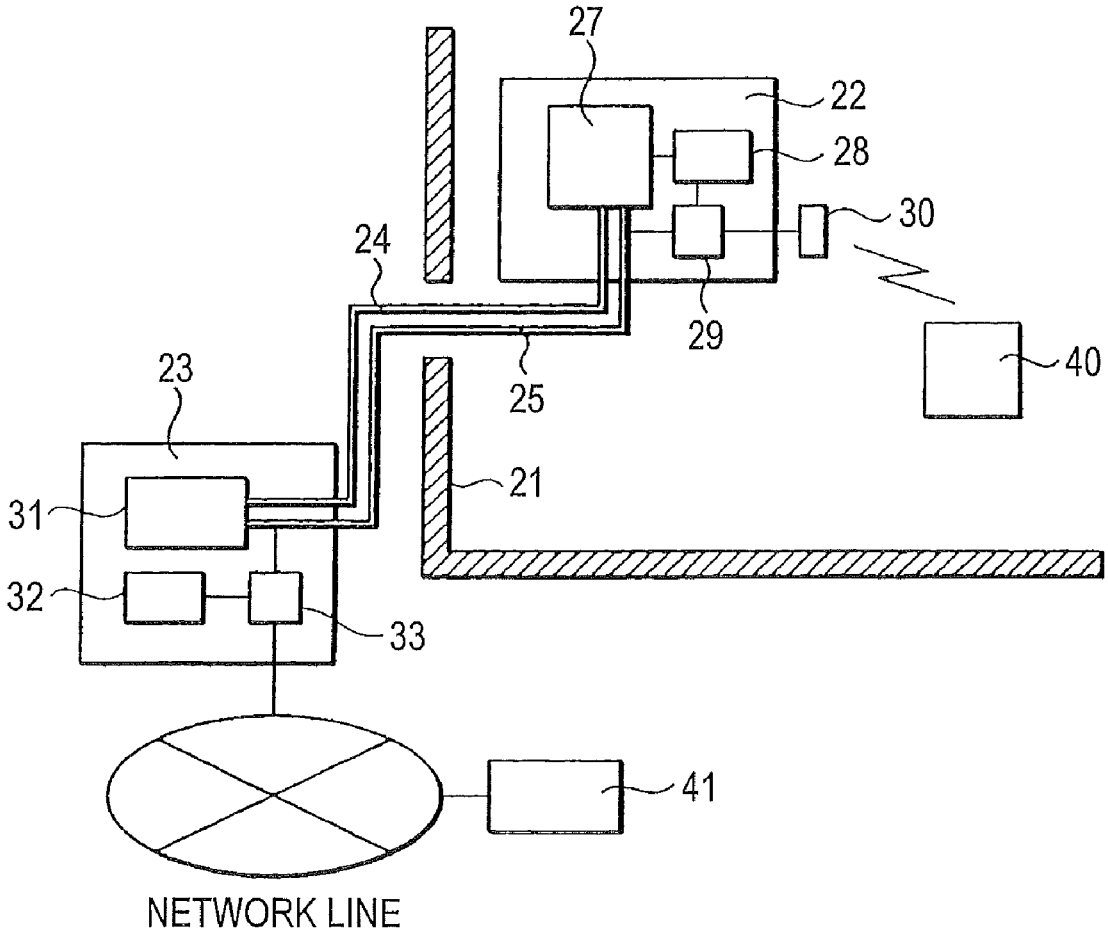
FIG. 18 is a block diagram showing an electric-appliance network system which employs the airconditioning equipment according to Embodiment 4.
Figure 19:
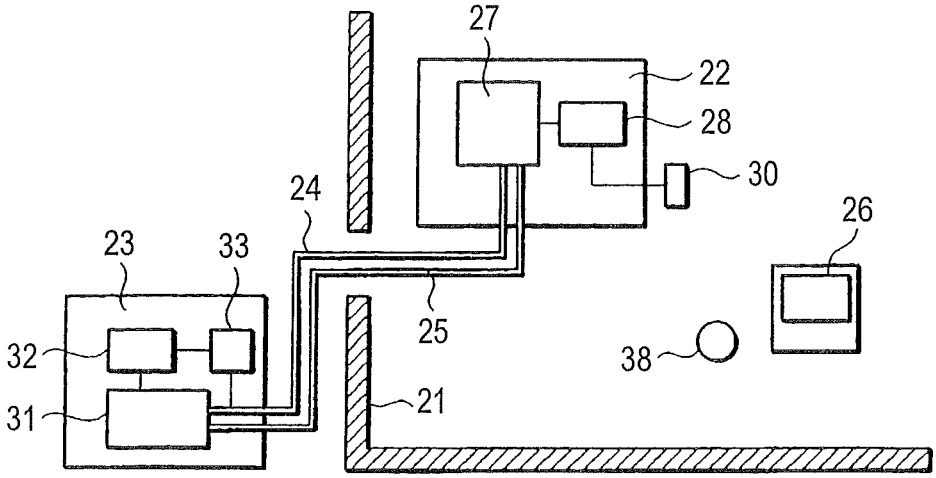
FIG. 19 is a block diagram showing the configuration of an airconditioning equipment according to Embodiment 5.
Figure 20:
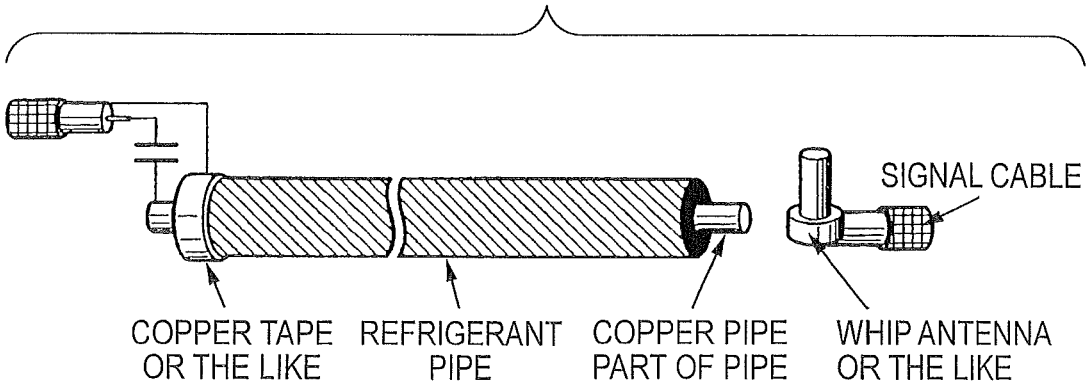
FIG. 20 is a view showing a practicable example of the coupling between the antenna and refrigerant pipe of an in-room unit according to Embodiment 5.
Figure 21:
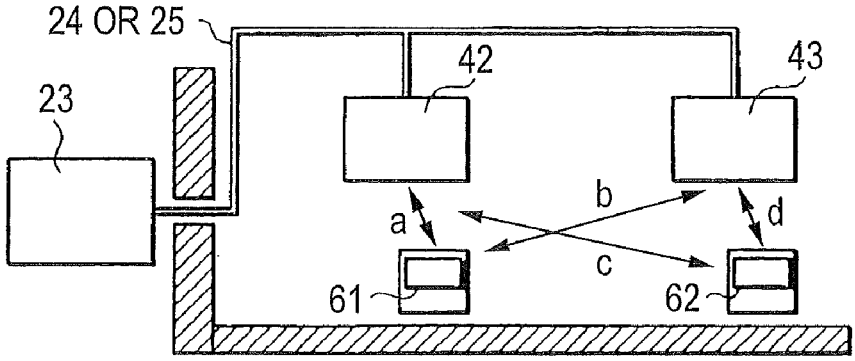
FIG. 21 is a block diagram showing an example of a system architecture which employs the airconditioning equipment according to Embodiment 5.
Figure 22:
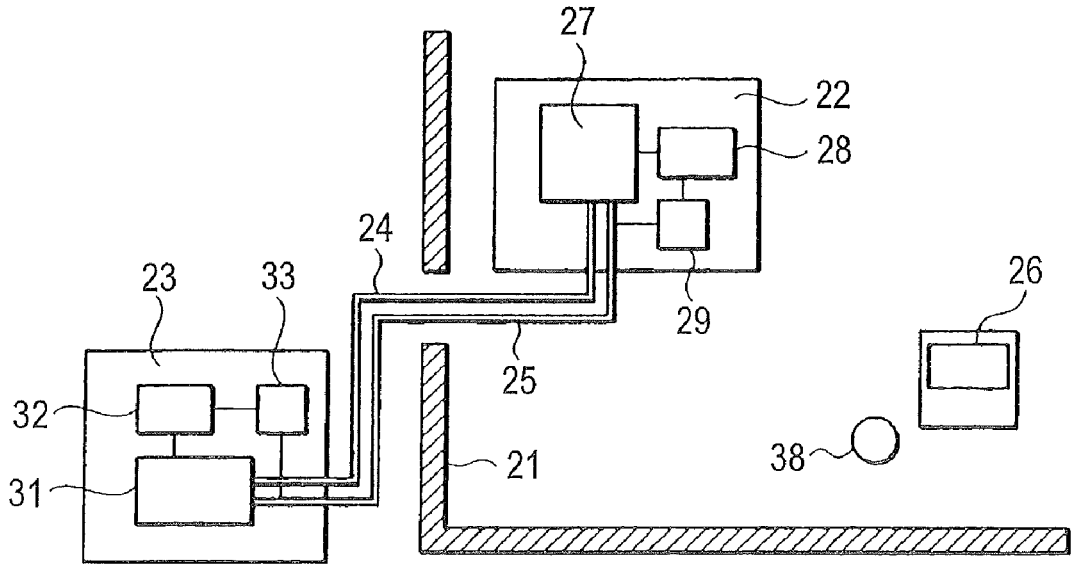
FIG. 22 is a block diagram showing another configuration of the airconditioning equipment according to Embodiment 5.
Figure 23:
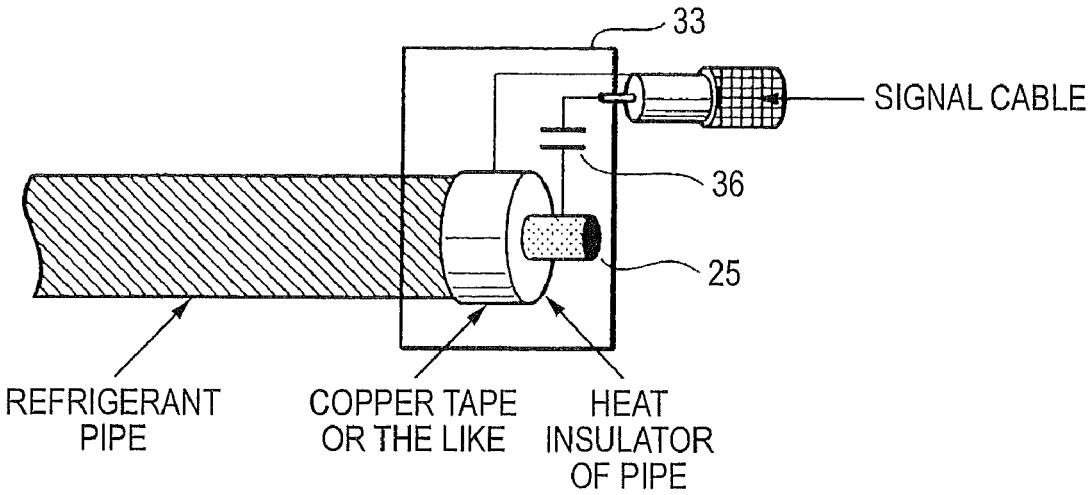
FIG. 23 is a view showing a practicable configurational example of the electrostatic coupling method of a coupler according to Embodiment 5.
Figure 24:
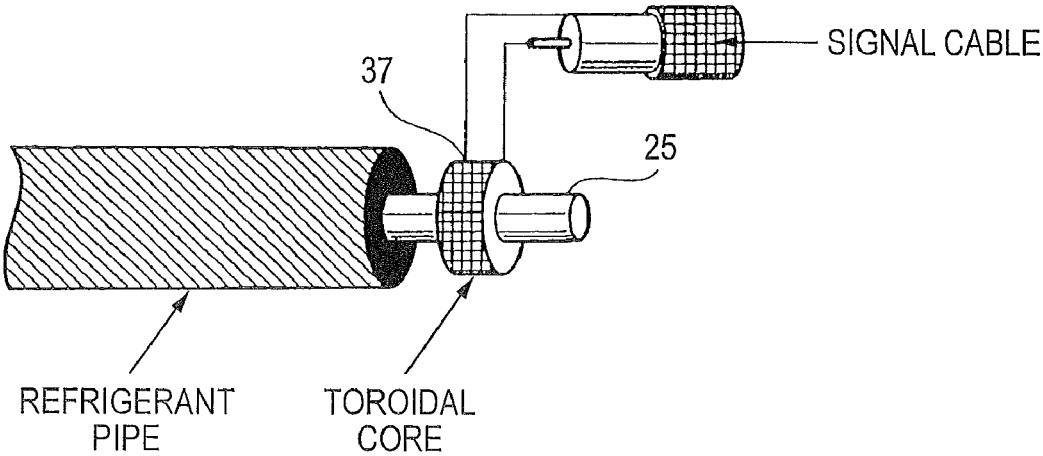
FIG. 24 is a view showing a practicable configurational example of the inductive coupling method of the coupler according to Embodiment 5.

1 out-room unit
2 in-room unit
3 liquid-side pipe
4 gas-side pipe
5 out-room unit refrigerant circuit
6 out-room unit control circuit
7 signal coupling circuit (signal coupling portion)
8 in-room unit refrigerant circuit
9 in-room unit control circuit
10 outer wall
11 core
11*a* partial core piece
12 coupling clamp
13 connection terminal
13*a* contact portion
13*b* connection portion
15 heat insulator
16 control signal cable
17 control-signal coaxial cable
18 excitation portion
19 building structure
21 outer wall
22 in-room unit

23 out-room unit
24 gas-side refrigerant pipe
25 liquid-side refrigerant pipe
26 remote controller
27 in-room unit refrigerant circuit
28 in-room unit control circuit
29 signal distribution circuit
30 indoor antenna
31 out-room unit refrigerant circuit
32 out-room unit control circuit
33 coupler
34 distributor
35 coupler
36 coupling capacitor
37 induction coil
38 sensor
40 information/electric appliance
41 external control device
42 first in-room unit
43 second in-room unit
61 first remote controller second remote controller

The invention claimed is:

1. An airconditioning equipment, comprising:

a refrigerant pipe;

an in-room unit which is connected to one end of the refrigerant pipe; and an out-room unit which is connected to the other end of the refrigerant pipe; wherein the in-room unit includes a first coupler which couples an electric signal to the refrigerant pipe, so as to transmit a radio wave signal generated by the coupling, to the out-room unit along a surface layer of the refrigerant pipe, and which extracts a radio wave signal transmitted from the out-room unit and then converts the radio wave signal into an electric signal and wherein the out-room unit includes a second coupler which couples an electric signal to the refrigerant pipe, so as to transmit a radio wave signal generated by the coupling, to the in-room unit along the surface layer of the refrigerant pipe, and which extracts a radio wave signal transmitted from the in-room unit and then converts the radio wave signal into an electric signal.

2. An airconditioning equipment as defined in claim 1, wherein at least one of the first and second couplers includes a coupling capacitor connected to the refrigerant pipe, so as to electrostatically couple the electric signal to the refrigerant pipe through said coupling capacitor.

3. An airconditioning equipment as defined in claim 1, wherein at least one of the first and second couplers includes an induction coil arranged along the refrigerant pipe, so as to inductively couple the electric signal to the refrigerant pipe by causing the electric signal to flow through said induction coil.

4. An airconditioning equipment as defined in claim 1, wherein: the in-room unit includes a transmission/reception portion which receives and transmits a signal from a remote controller, and a distributor which distributes the signal received and transmitted by said transmission/reception portion, to said first coupler and wherein communication signal formats of the manipulation signal and the electric signal are substantially identical.

5. An airconditioning equipment as defined in claim 1 wherein the out-room unit is connected to a network line and wherein at least one of the in-room unit and the out-room unit is remote-manipulatable from an external control device which is connected to said network line.

6. An airconditioning equipment as defined in claim 1 wherein the out-room unit is connected to a network line, and wherein an electric appliance which is connected with the in-room unit by radio or wire is remote-manipulatable from an external control device which is connected to said network line.

7. An airconditioning equipment as defined in claim 1 wherein the refrigerant pipe is partly or wholly surrounded with a heat insulator which is made of a substance having a relative permittivity greater than that of air.

8. A communication method for airconditioning equipment between a first unit connected to one end of a pipe formed of an electrically conductive substance and a second unit connected to an other end of the pipe, the method comprising:

providing a coupling for attaching an electric signal from either the first unit or the second unit to the pipe;

generating an electric signal from either of the first unit and the second unit;

receiving the electric signal via the coupling for converting the electric signal to generate a radio wave signal;

attaching the electric signal from either of the first unit and the second unit to the pipe, so as to transmit the radio wave signal generated by the coupling;

transmitting the radio wave signal along a surface layer of the pipe to the other of the first unit and the second unit.

9. A communication method for an airconditioning equipment as defined in claim 8, wherein the attaching of the electric signal to the pipe is electrostatic through a capacitor which is connected to the pipe.

10. A communication method for an airconditioning equipment as defined in claim 8, wherein the attaching of the electric signal to the pipe is inductive which is based on flow of the electric signal through an induction coil arranged along the pipe.

* * * * *